US012765653B2

(12) United States Patent
Billings

(10) Patent No.: US 12,765,653 B2
(45) Date of Patent: Oct. 20, 2026

(54) CRAFTWORK TOOL AND NOTION STORAGE KITS

(71) Applicant: Stitchcraft Solutions, LLC, Shaker Heights, OH (US)

(72) Inventor: Elizabeth Ann Conrad Billings, Shaker Heights, OH (US)

(73) Assignee: Stitchcraft Solutions, LLC, Shaker Heights, OH (US)

( * ) Notice: Subject to any disclaimer, the term of this patent is extended or adjusted under 35 U.S.C. 154(b) by 51 days.

(21) Appl. No.: 19/008,078

(22) Filed: Jan. 2, 2025

(65) Prior Publication Data

US 2026/0182714 A1 Jul. 2, 2026

(51) Int. Cl.
*A45C 13/02* (2006.01)
*B65D 85/24* (2006.01)
*D04B 3/00* (2006.01)

(52) U.S. Cl.
CPC ..... *A45C 13/02* (2013.01); *B65D 85/24* (2013.01); *D04B 3/00* (2013.01)

(58) Field of Classification Search
CPC ... B65D 85/24; D04B 3/00; B42F 7/06; B42F 7/065; B42F 13/00; B42F 13/40; B42F 5/00; B42F 5/04; A45C 11/00; A45C 11/18; A45C 13/00; A45C 13/02; G09F 3/00
See application file for complete search history.

(56) References Cited

U.S. PATENT DOCUMENTS 3,749,233 A * 7/1973 McCormick, Jr. ..... A45C 11/26 312/902
3,870,223 A * 3/1975 Wyant ..... B65D 27/08 281/31
3,884,412 A * 5/1975 Price ..... B65D 75/42 229/69
4,260,056 A * 4/1981 Horvath ..... A61B 17/06061 206/370
4,478,333 A * 10/1984 Dalbo ..... A45F 3/48 223/109 R
4,640,413 A * 2/1987 Kaplan ..... G11B 33/0494 281/31
4,802,575 A * 2/1989 Martin ..... A45C 13/02 206/214

(Continued)

FOREIGN PATENT DOCUMENTS

KR 200307470 Y1 3/2003

*Primary Examiner* — Dariush Seif
(74) *Attorney, Agent, or Firm* — Vorys, Sater, Seymour and Pease, LLP; Michael Messinger

(57) ABSTRACT

Craftwork tool and notion storage kits include: a plurality of stickers, a plurality of flat craftwork tool and notion storage pocket inserts and/or a plurality of patterns for the inserts, and/or a plurality of folded craftwork tool and notion storage pocket sleeves, and/or plurality of patterns for the sleeves. Each insert and/or each sleeve is sized to fit into one or more of a plurality of storage pockets of a transparent ring binder storage sheet sized to fit into a ring binder. Each storage pocket is sized to hold one or more craftwork tools and/or notions and one of the inserts and/or the sleeves. Each sleeve is sized to hold an inserted end of the craftwork tools and/or the craftwork notions. Methods of preparing a craftwork tool and notion storage kit and methods of preparing a plurality of sleeves are disclosed.

8 Claims, 15 Drawing Sheets

(56) References Cited

U.S. PATENT DOCUMENTS 5,080,223 A * 1/1992 Mitsuyama ..... A45C 11/182 150/147
5,184,729 A * 2/1993 Zalenski ..... A45F 3/48 D9/423
5,199,743 A * 4/1993 Rosinski, III ..... G11B 33/0494 281/31
5,316,404 A * 5/1994 Hensel ..... B42D 5/00 40/721
5,377,733 A * 1/1995 Halley ..... B42F 5/00 150/147
5,501,540 A * 3/1996 Ho ..... B42F 5/00 281/38
5,545,087 A * 8/1996 Seward ..... B42F 15/04 229/67.2
5,573,110 A * 11/1996 Nguyen ..... B42F 7/065 150/147
5,590,911 A * 1/1997 Wilson ..... B42F 13/40 283/37
5,697,502 A * 12/1997 Linz ..... B65D 73/0085 206/395
6,039,495 A * 3/2000 Zimmerman ..... B42F 13/40 206/463
6,135,662 A * 10/2000 Bakke ..... B42F 7/025 281/38
6,155,738 A * 12/2000 King ..... G09F 5/04 281/31
6,390,714 B1 * 5/2002 Bradley ..... B42F 5/005 281/38
6,443,301 B2 * 9/2002 Garnier ..... G11B 33/0494 281/31
6,505,739 B2 * 1/2003 Garnier ..... G11B 33/0422 229/72
6,632,042 B1 * 10/2003 Liener Chin ..... B42F 21/00 402/79
7,037,021 B2 * 5/2006 Raschke ..... B42F 7/025 281/38
7,270,437 B1 * 9/2007 Racoosin ..... A45C 15/06 362/240
7,422,111 B1 * 9/2008 Bridger ..... A45F 3/48 206/574
7,780,369 B2 * 8/2010 Penn ..... B42F 7/06 402/79
8,215,537 B2 * 7/2012 Makofsky ..... B65D 5/0005 229/928
9,296,247 B2 * 3/2016 Christensen ..... B42F 7/06
9,815,614 B2 * 11/2017 Griffin ..... B65D 85/24
10,479,131 B2 * 11/2019 Stevens ..... B42F 7/145
10,759,215 B1 * 9/2020 Ramsey Orr ..... B42F 13/26
10,940,991 B2 * 3/2021 Elalouf ..... A45C 11/24
2003/0059248 A1 * 3/2003 Walton ..... B42F 21/02 402/79
2005/0207828 A1 * 9/2005 Walker ..... B42F 5/00 402/79
2005/0253371 A1 * 11/2005 Connolly ..... B42D 1/00 281/22
2006/0283768 A1 * 12/2006 Schriner ..... A45C 13/02 206/574
2008/0105577 A1 * 5/2008 Stingel ..... D04B 37/00 206/380
2009/0309351 A1 * 12/2009 Bemiss ..... A45C 11/18 281/31
2010/0028538 A1 * 2/2010 Jones ..... B41F 21/04 427/256
2010/0263334 A1 * 10/2010 Gilmore ..... D04B 3/00 53/473
2011/0186470 A1 * 8/2011 Ganti ..... B65D 33/007 206/538
2012/0009548 A1 * 1/2012 Feit ..... G09F 5/042 434/95
2012/0091018 A1 * 4/2012 Bock ..... B42F 7/065 206/307
2012/0111930 A1 * 5/2012 Maistrellis ..... B42F 21/06 283/37
2015/0151563 A1 * 6/2015 Brennan ..... B42F 7/065 402/31
2016/0288972 A1 * 10/2016 Kirkham ..... B65D 73/0035
2018/0116352 A1 * 5/2018 Despain ..... A45C 1/06
2021/0277558 A1 * 9/2021 Chen ..... B26D 7/20
2025/0214364 A1 * 7/2025 Murphy ..... B42F 7/08
2026/0026591 A1 * 1/2026 Carol ..... A45C 11/26

* cited by examiner

CRAFTWORK TOOL AND NOTION STORAGE KITS

FIELD OF THE DISCLOSURE

The present disclosure relates generally to kits for storing and organizing craftwork tools and notions, and methods relating thereto, particularly tools and notions used in sewing and needlework, and methods relating thereto.

BACKGROUND OF THE DISCLOSURE

Currently available craftwork tool and notion storage kits, while useful for organizing and protecting craftwork tools and notions, have various disadvantages. Many craftwork tool and notion storage kits come with pre-defined compartments and slots, which are non-customizable such that not all types, sizes, or lengths of tools or materials may be accommodated. This may be particularly problematic for users with a diverse range of craftwork tools or craftwork notions that vary in size and shape. Some kits may not offer enough space for larger tools or an expanding collection of supplies or may not offer the ability to rearrange compartments to make efficient use of the available space. This may lead to the need for multiple storage solutions, which may be cumbersome and inefficient. While some kits are designed to be portable, others may be bulky or heavy, and therefore difficult to transport. This is especially true for kits made of heavier materials like metal. This may be a disadvantage for users who need to move their tools frequently or work in different locations.

The quality of materials used in craftwork tool and notion storage kits may vary significantly. Lower-quality kits may not withstand heavy use or the weight of heavier tools, leading to wear and tear or even breakage over time. Many kits are made from non-biodegradable materials. These materials may take hundreds of years to decompose, contributing to long-term environmental pollution. There are also limited options for eco-friendly kits on the market. This makes it difficult for consumers who are conscious of their environmental impact to find sustainable alternatives.

Some craftwork tool and notion storage kits may not provide easy access to tools, requiring users to unpack multiple layers or compartments to reach what they need. This may be time-consuming and frustrating during a project. This is particularly a problem for opaque storage kits, which do not allow users to see the contents without opening the kit. Similarly, kits which do not provide labels for tools make it challenging to quickly identify specific tools within the kit. Unlabeled tools may require users to spend additional time searching through the kit to find the needed item and may be more easily misplaced or stored in the wrong compartments, resulting in confusion and difficulty in locating tools when they are needed.

Thus, there is a need for craftwork tool and notion storage kits which allow the user to store and organize their craftwork tools and notions in a way that accommodates and creates a designated, labeled, and transparent space for various types, sizes, and/or lengths of craftwork tools and notions, that is expandable and designed for rearranging of storage spaces, that is easily stored and transported, and that is made of durable and renewable materials.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a craftwork tool and notion storage kit is provided having a plurality of stickers disposed on one or more sticker sheets, a plurality of flat craftwork tool and notion storage pocket inserts ("inserts") and/or a plurality of insert patterns disposed on a top side of one or more sheets ("insert pattern sheets"), a plurality of folded craftwork tool and notion storage pocket sleeves ("sleeves") and/or a plurality of patterns for the plurality of sleeves disposed on a top side of one or more sheets ("sleeve pattern sheets").

In further aspects, each insert and/or each sleeve is sized to fit into one or more of a plurality of storage pockets of one or more transparent ring binder storage sheets. Each storage pocket is sized to hold one or more craftwork tools and/or notions and one of the inserts and/or the sleeves, each inserted into the storage pocket via an opening of the storage pocket. Each sleeve has one folded end forming a sleeve opening opposite to the folded end. The sleeve is sized to hold the inserted end of one or more of the craftwork tools and/or the craftwork notions. Each craftwork tool and/or notion inserted into the sleeve via the sleeve opening when the sleeve opening has the same orientation as the storage pocket opening. The plurality of stickers have blank stickers, stickers each printed with one of a plurality of sizes of the craftwork tools and/or the craftwork notions, stickers each printed with one of a plurality of lengths of the craftwork tools and/or the craftwork notions, and/or stickers each printed with a plurality of types of the craftwork tools and/or the craftwork notions.

In a further feature, the plurality of stickers are sized to adhere to one or more of the following: the inserts and/or the sleeves, the transparent ring binder storage sheets, one or more transparent or translucent envelopes sized to fit into one or more of the storage pockets and to hold one or more of the craftwork tools and/or the craftwork notions, and/or a ring binder sized to hold the one or more transparent ring binder storage sheets.

In another embodiment, a method of preparing a craftwork tool and notion storage kit is disclosed.

In a further embodiment, a method of preparing a plurality of sleeves is disclosed.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

Figure 4:
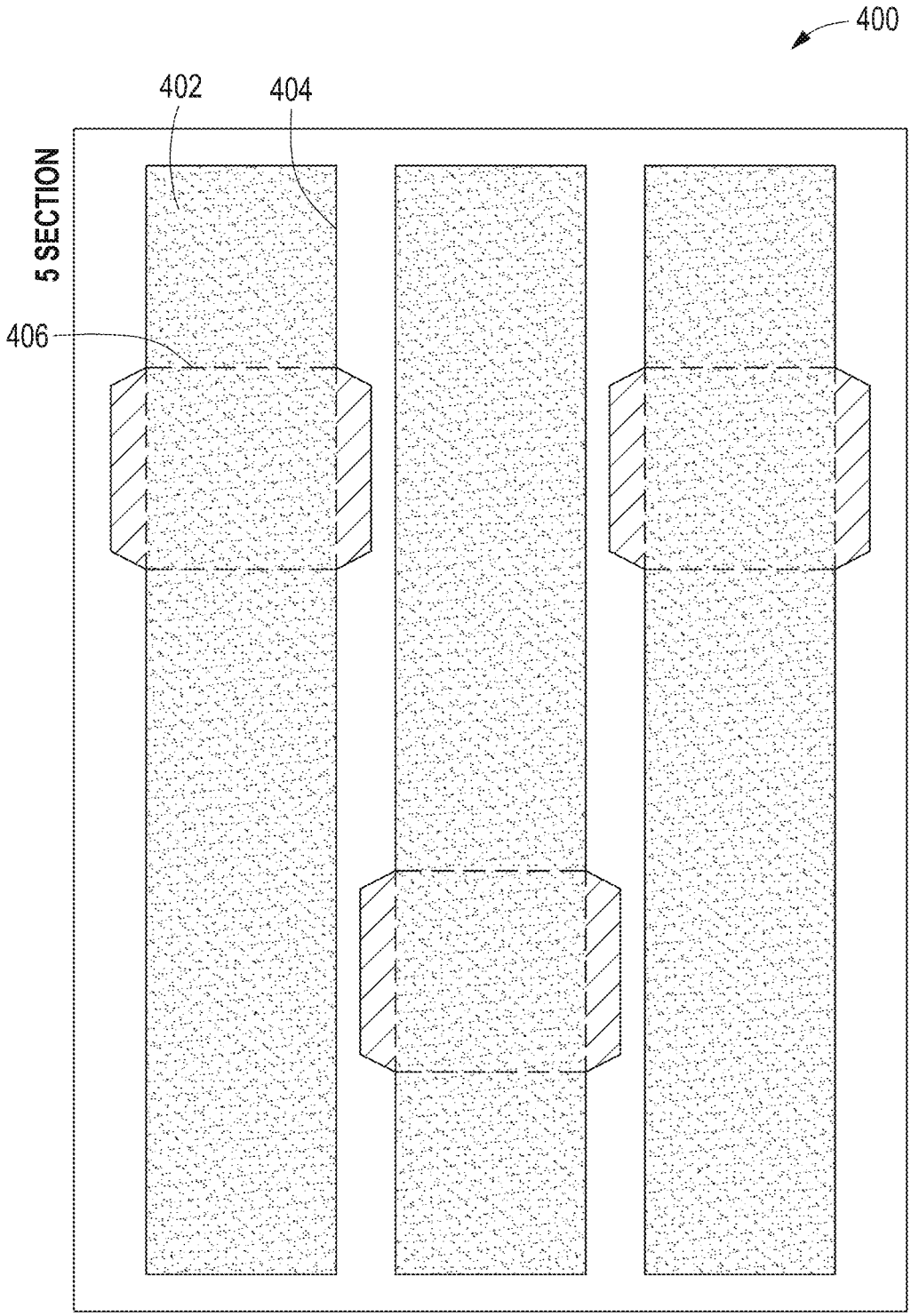

FIG. 4 illustrates a sleeve pattern sheet upon which is disposed a plurality of sleeve patterns for a plurality of sleeves, each sleeve sized to fit into the openings of the storage pockets of a transparent ring binder storage sheet having 5 rectangular storage pockets, in accordance with one embodiment.

Figure 5:
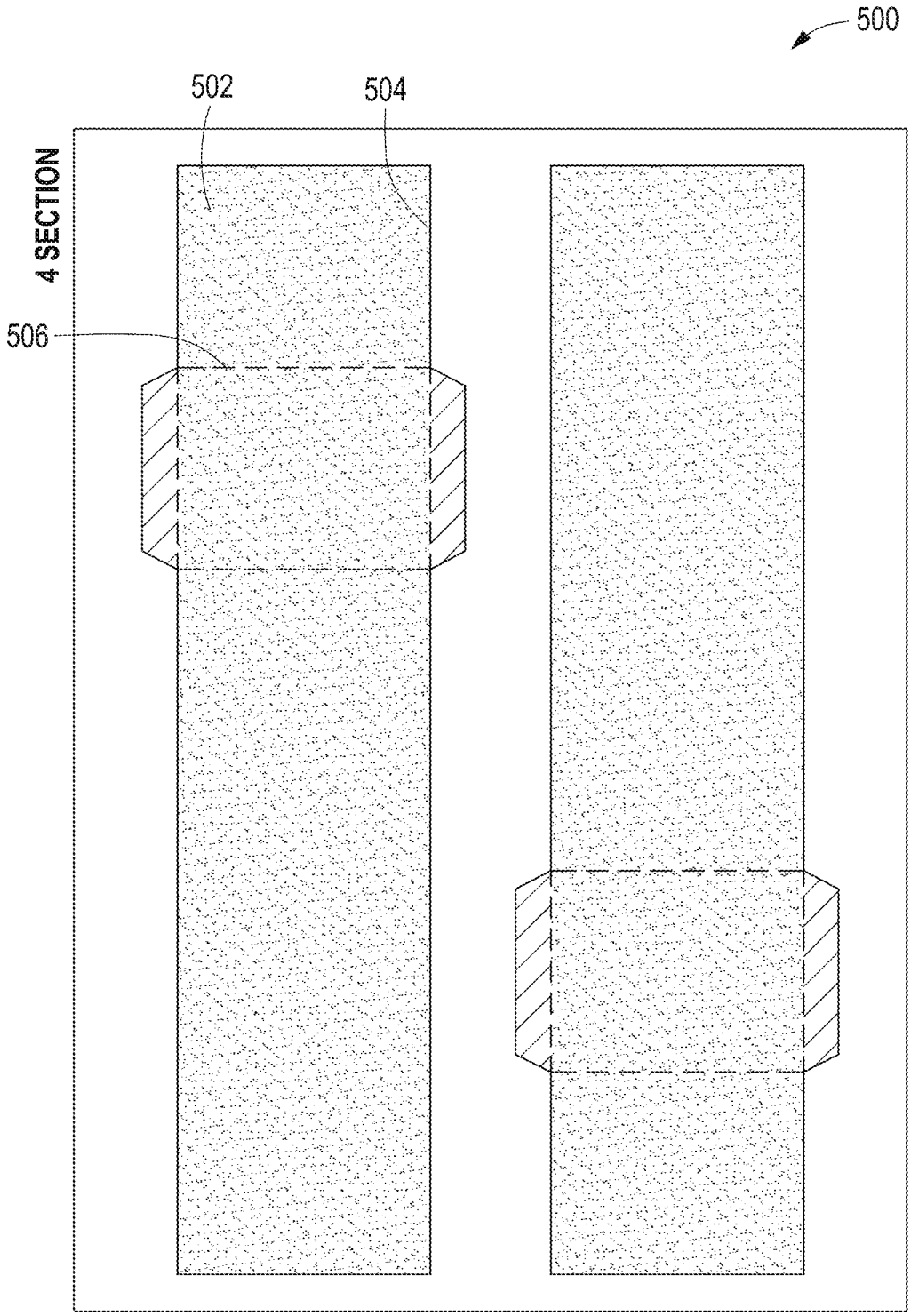

FIG. 5 illustrates a sleeve pattern sheet upon which is disposed a plurality of sleeve patterns for a plurality of sleeves, each sleeve sized to fit into the openings of the storage pockets of a transparent ring binder storage sheet having 4 rectangular storage pockets, in accordance with one embodiment.

Figure 6:
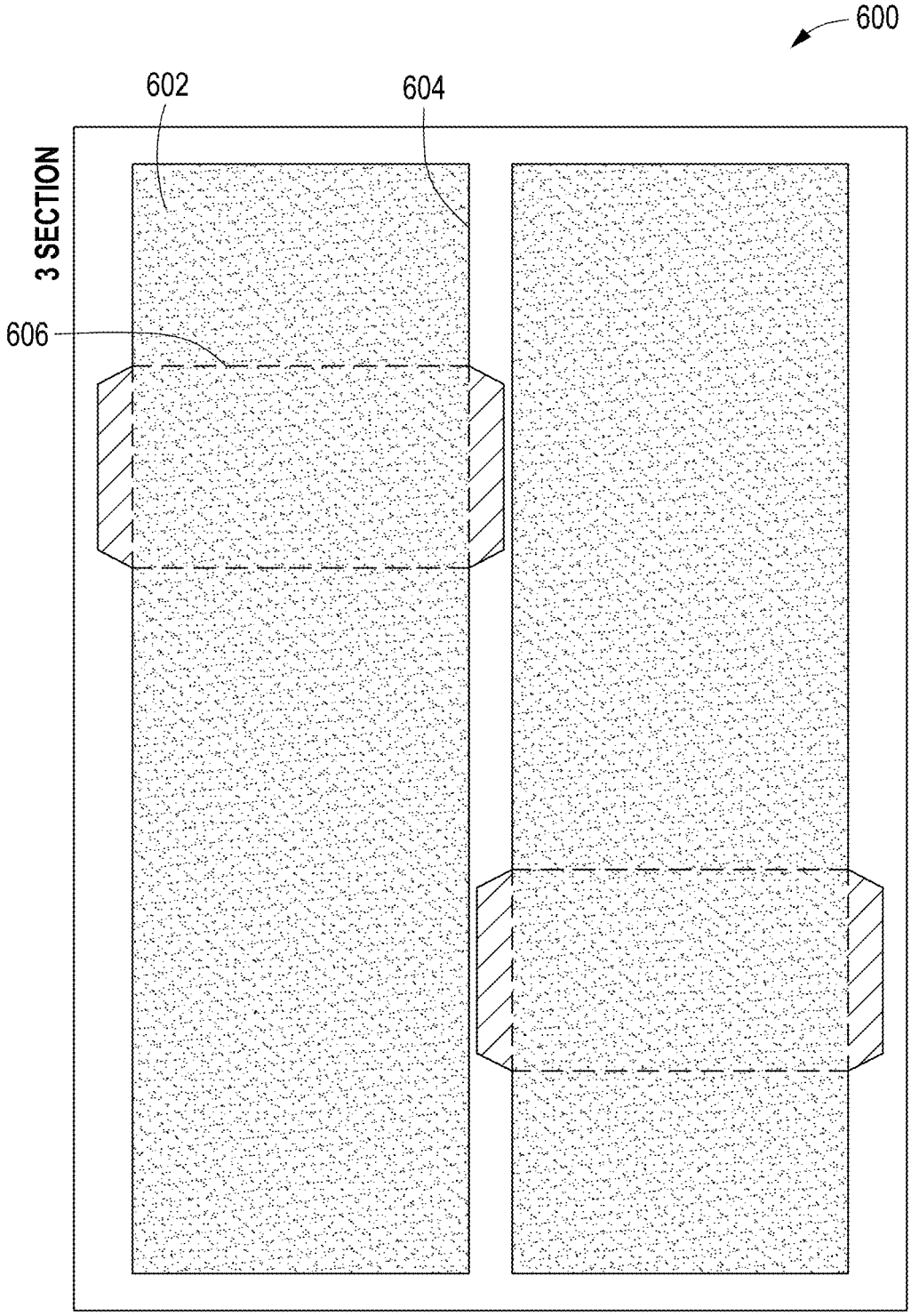

FIG. 6 illustrates a sleeve pattern sheet upon which is disposed a plurality of sleeve patterns for a plurality of sleeves, each sleeve sized to fit into the opening of the storage pockets of a transparent ring binder storage sheet having 3 rectangular storage pockets, in accordance with one embodiment.

Figure 7:
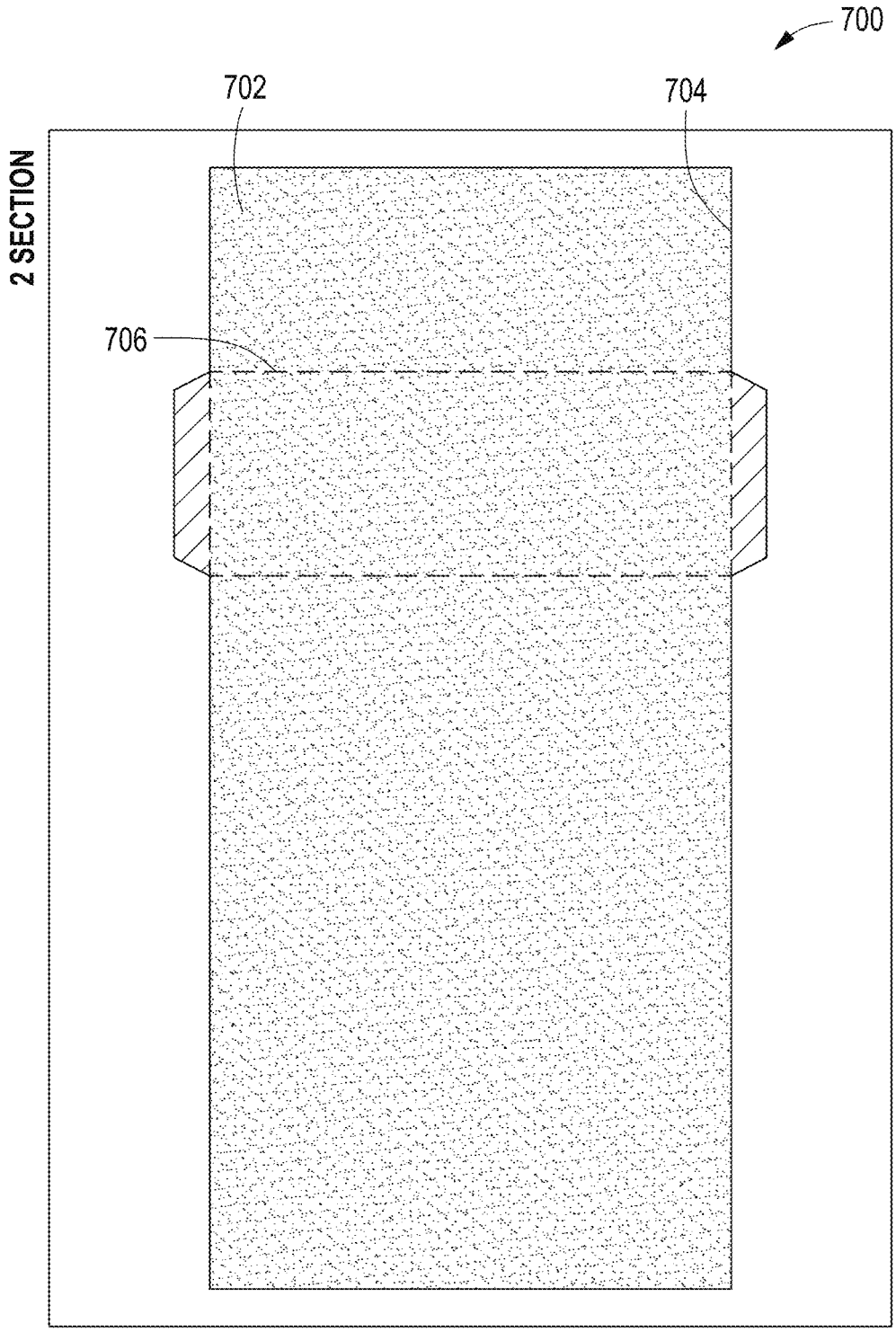

FIG. 7 illustrates a sleeve pattern sheet upon which is disposed one of a plurality of sleeve patterns for a plurality of sleeves, each sleeve sized to fit into the opening of the storage pockets of a transparent ring binder storage sheet having 2 rectangular storage pockets, in accordance with one embodiment.

Figure 8:
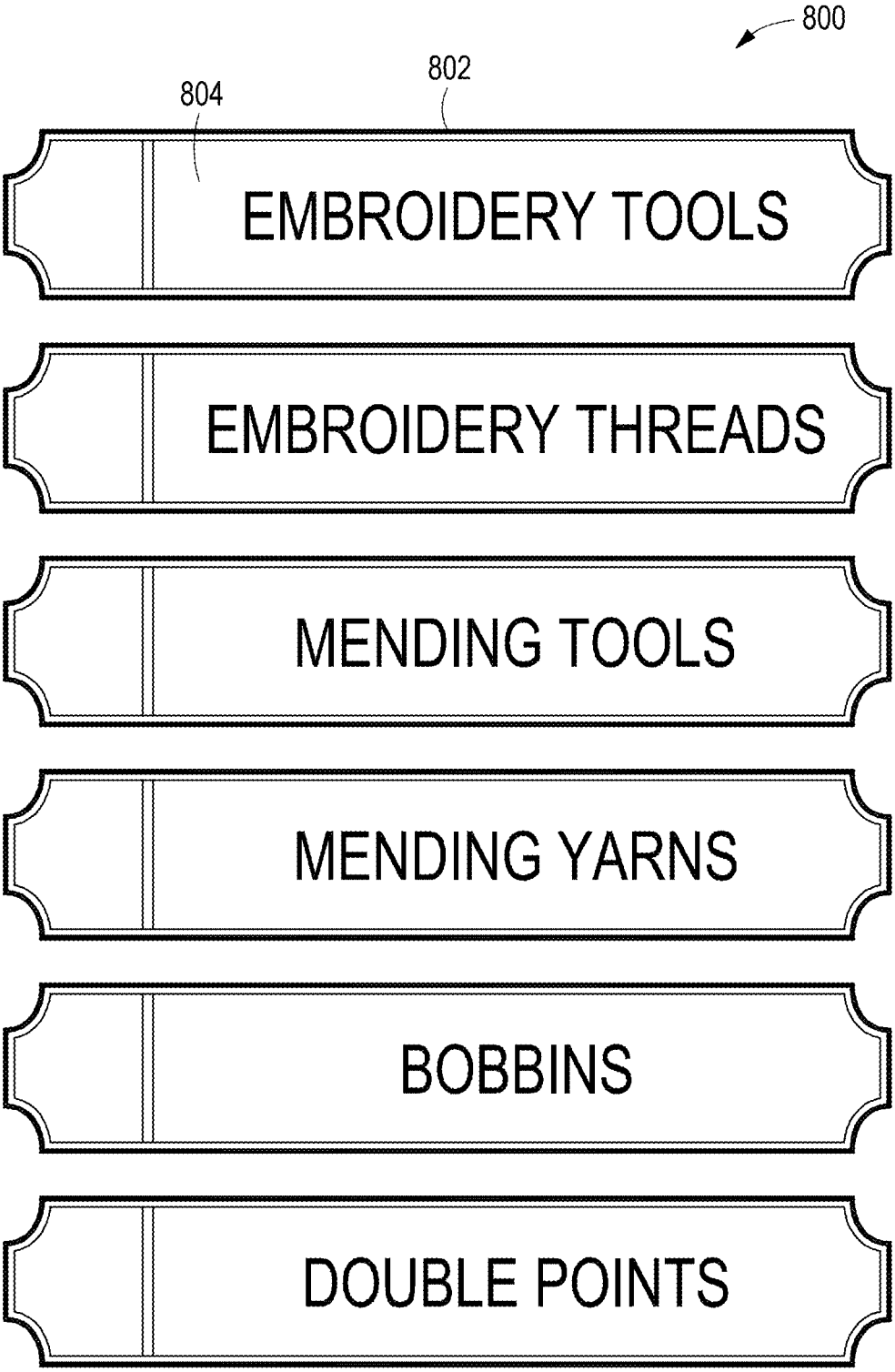

FIG. 8 illustrates exemplary stickers sized to fit onto a spine of a ring binder, the stickers printed with a type of a craftwork tool or a craftwork notion, in accordance with one embodiment.

Figure 9:
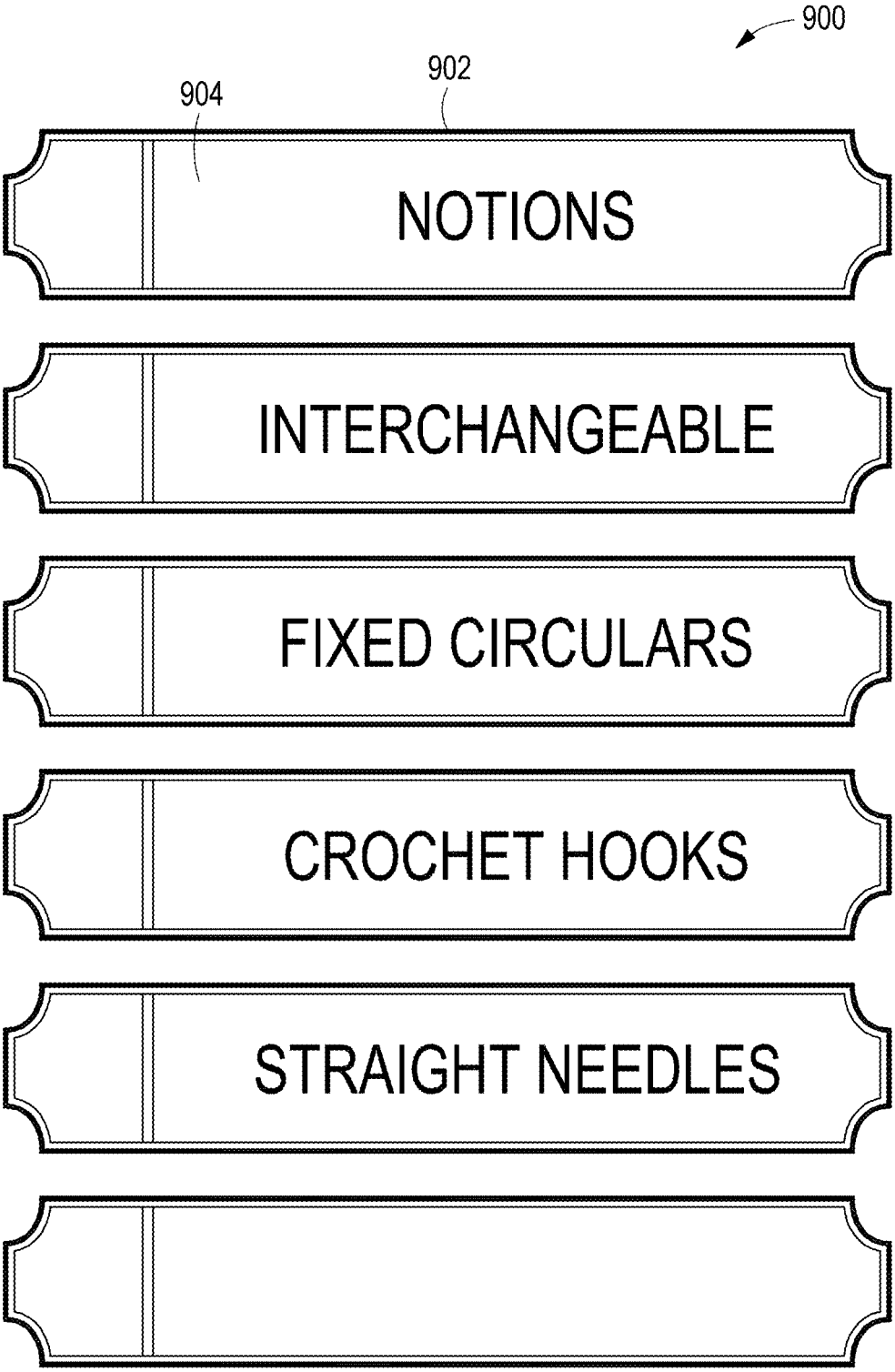

FIG. 9 illustrates exemplary stickers sized to fit onto a spine of a ring binder, the stickers either blank or printed with a type of a craftwork tool or a craftwork notion, in accordance with one embodiment.

Figure 10:
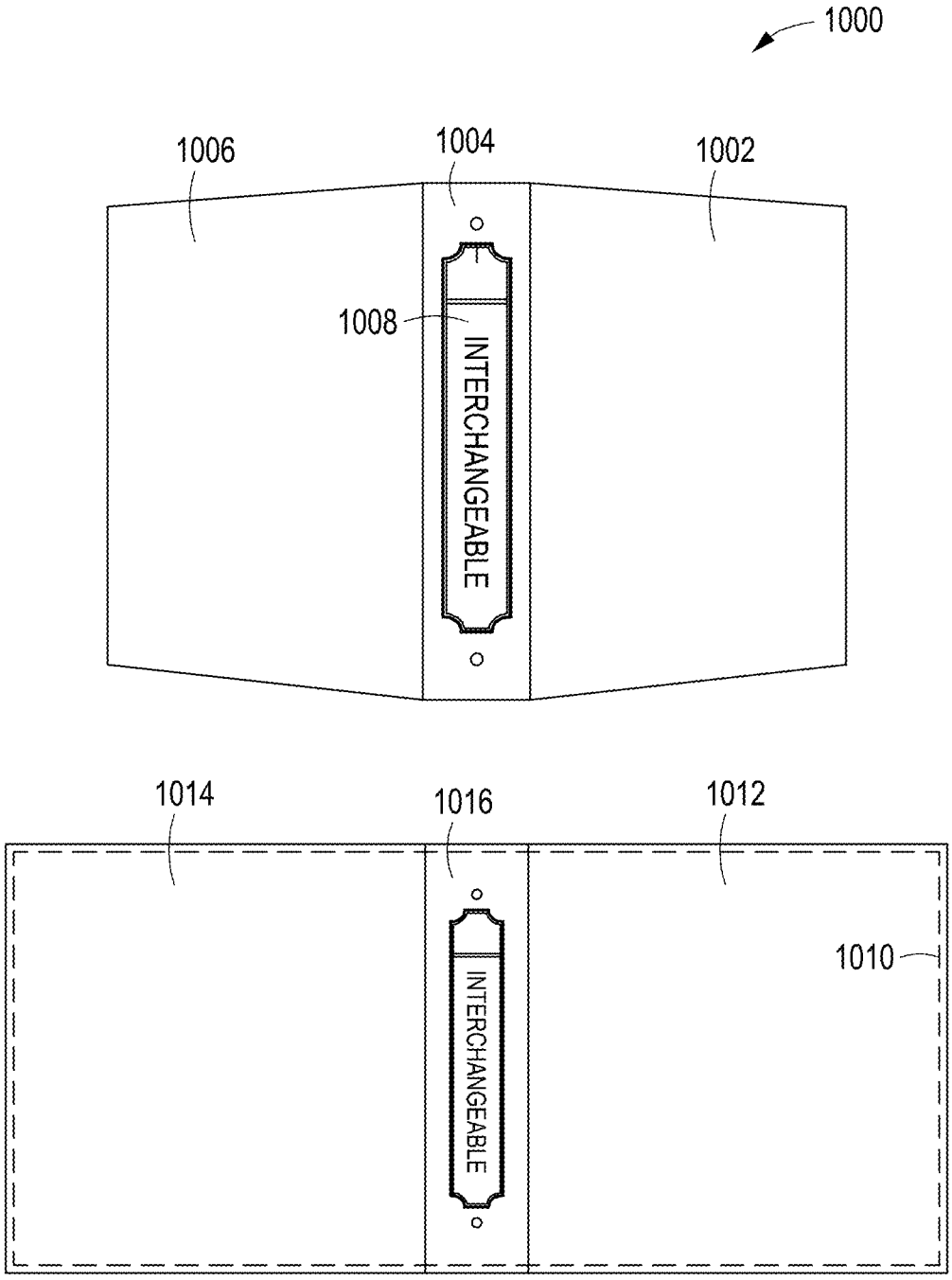

FIG. 10 illustrates a ring binder suitable for a craftwork tool and notion storage kit and further comprising a sticker adhered to a spine of the ring binder, the sticker printed with a type of a craftwork tool or a craftwork notion in accordance with one embodiment.

Figure 11:
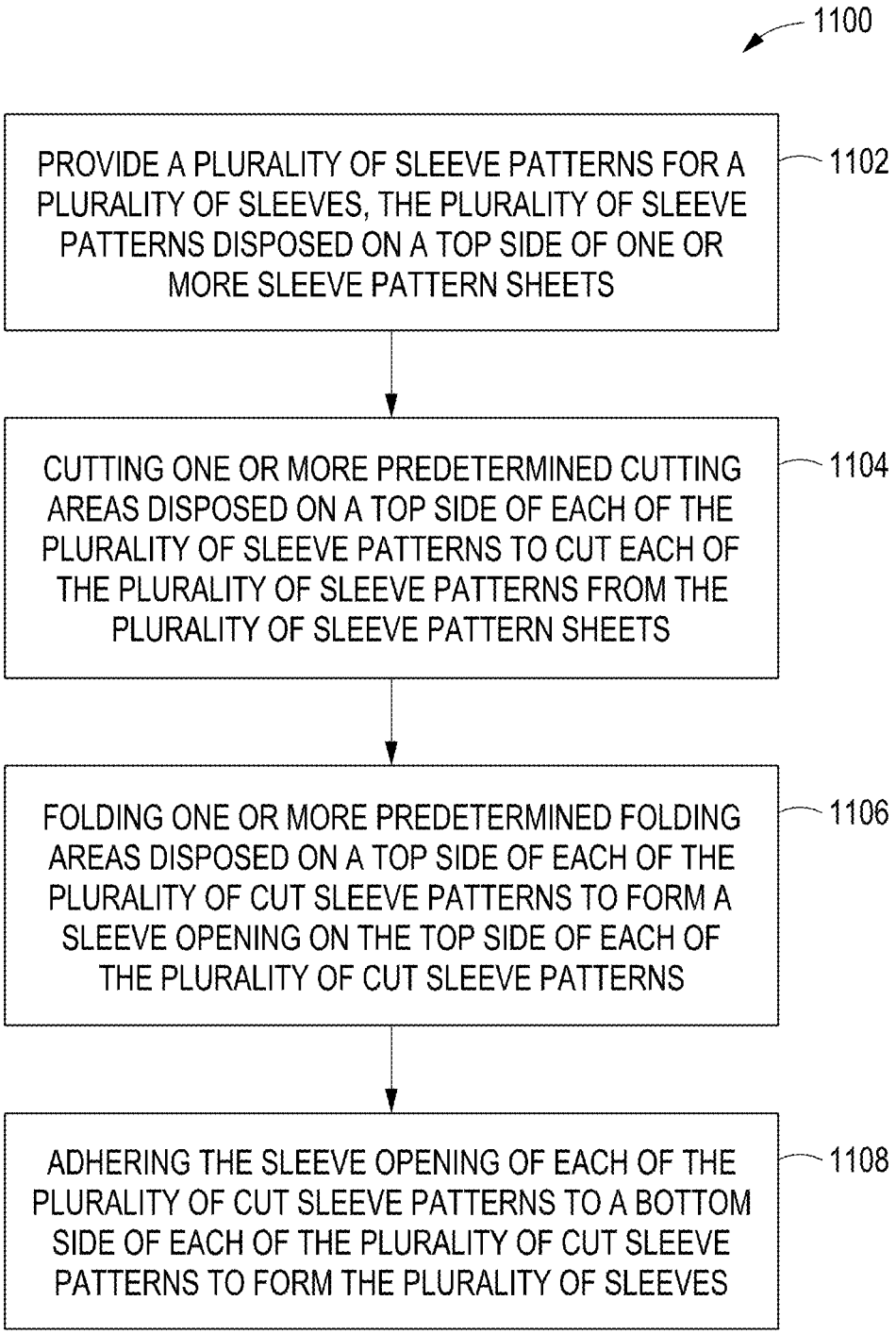

FIG. 11 illustrates a flowchart for a method of preparing each of a plurality of sleeves using a plurality of sleeve patterns, in accordance with one embodiment.

Figure 12:
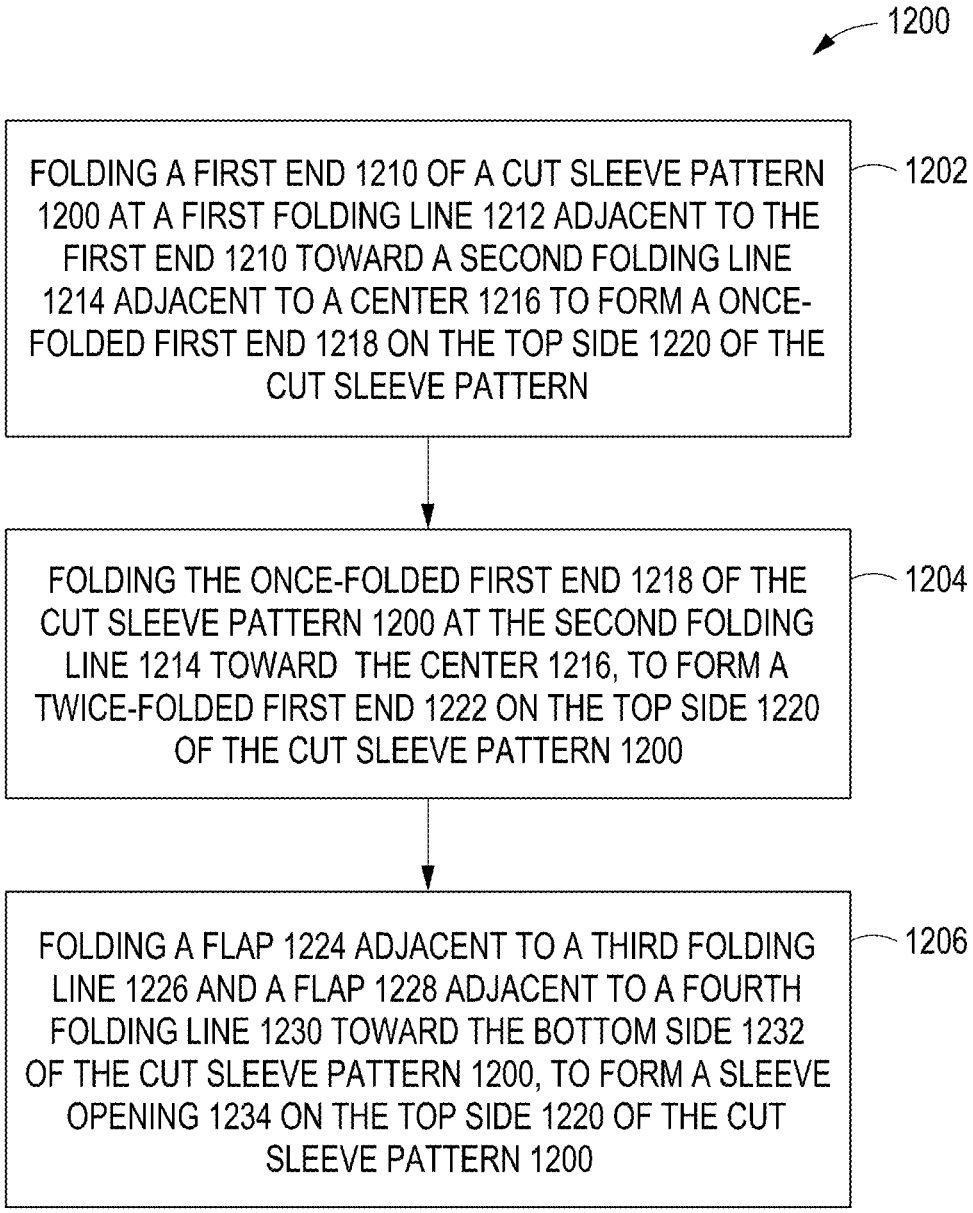
Figure 13:
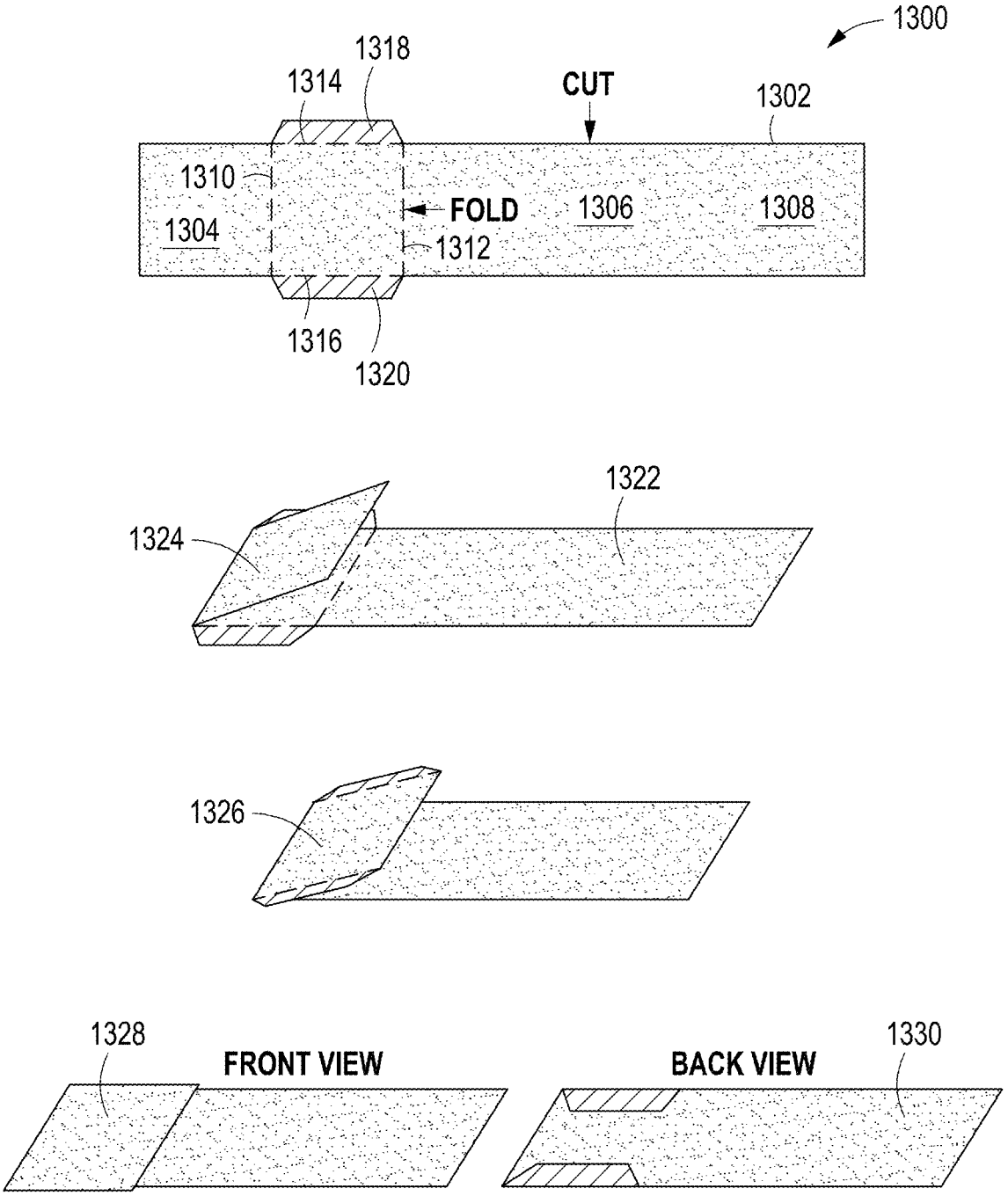

FIG. 12 illustrates a flowchart for a method of folding a plurality of cut sleeve patterns as illustrated in FIG. 13, in accordance with one embodiment.

FIG. 13 illustrates a method of folding each of a plurality of cut sleeve patterns.

Figure 14:
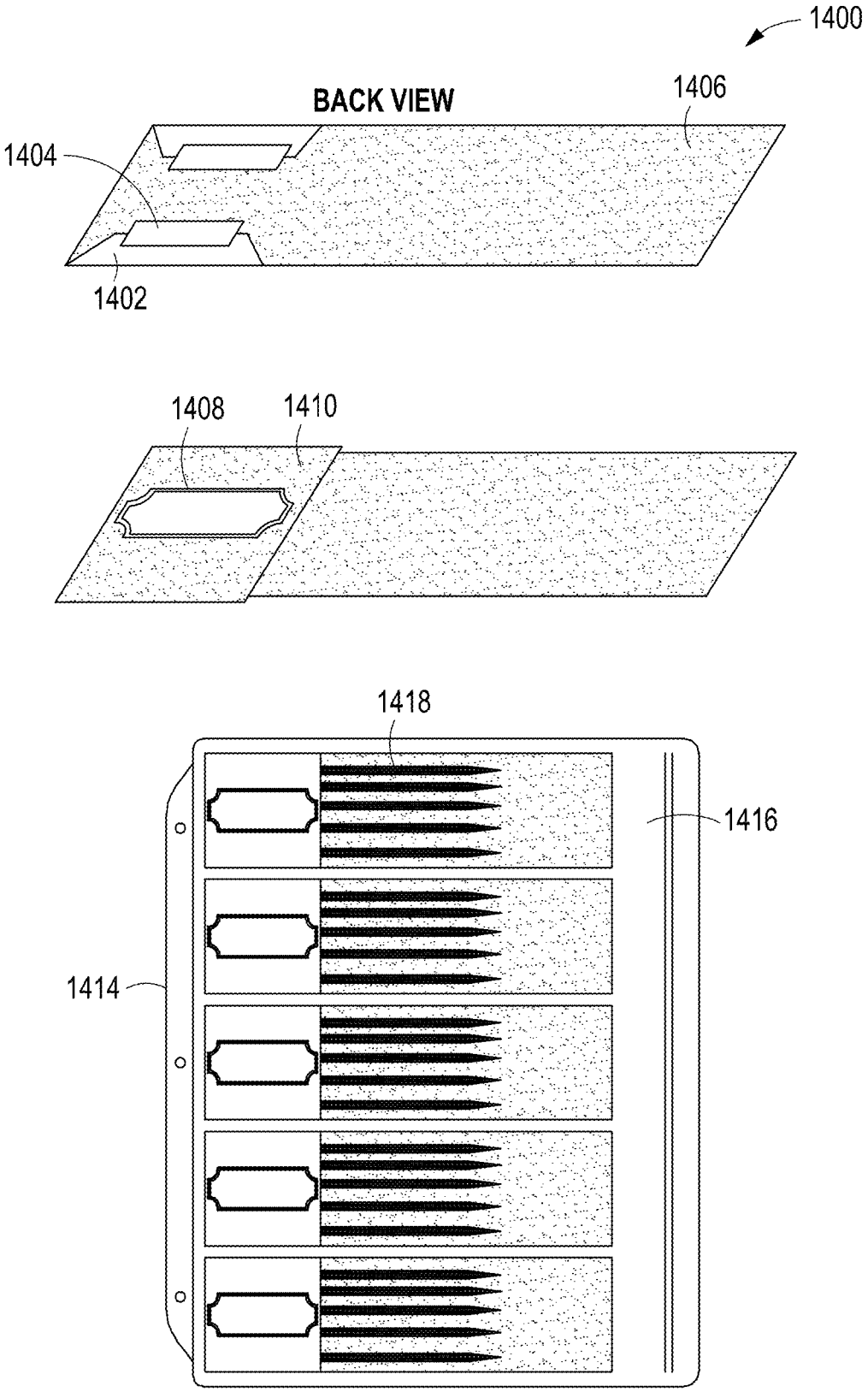

FIG. 14 illustrates a method of preparing a plurality of sleeves from a plurality of cut sleeve patterns, in accordance with one embodiment.

Figure 15:
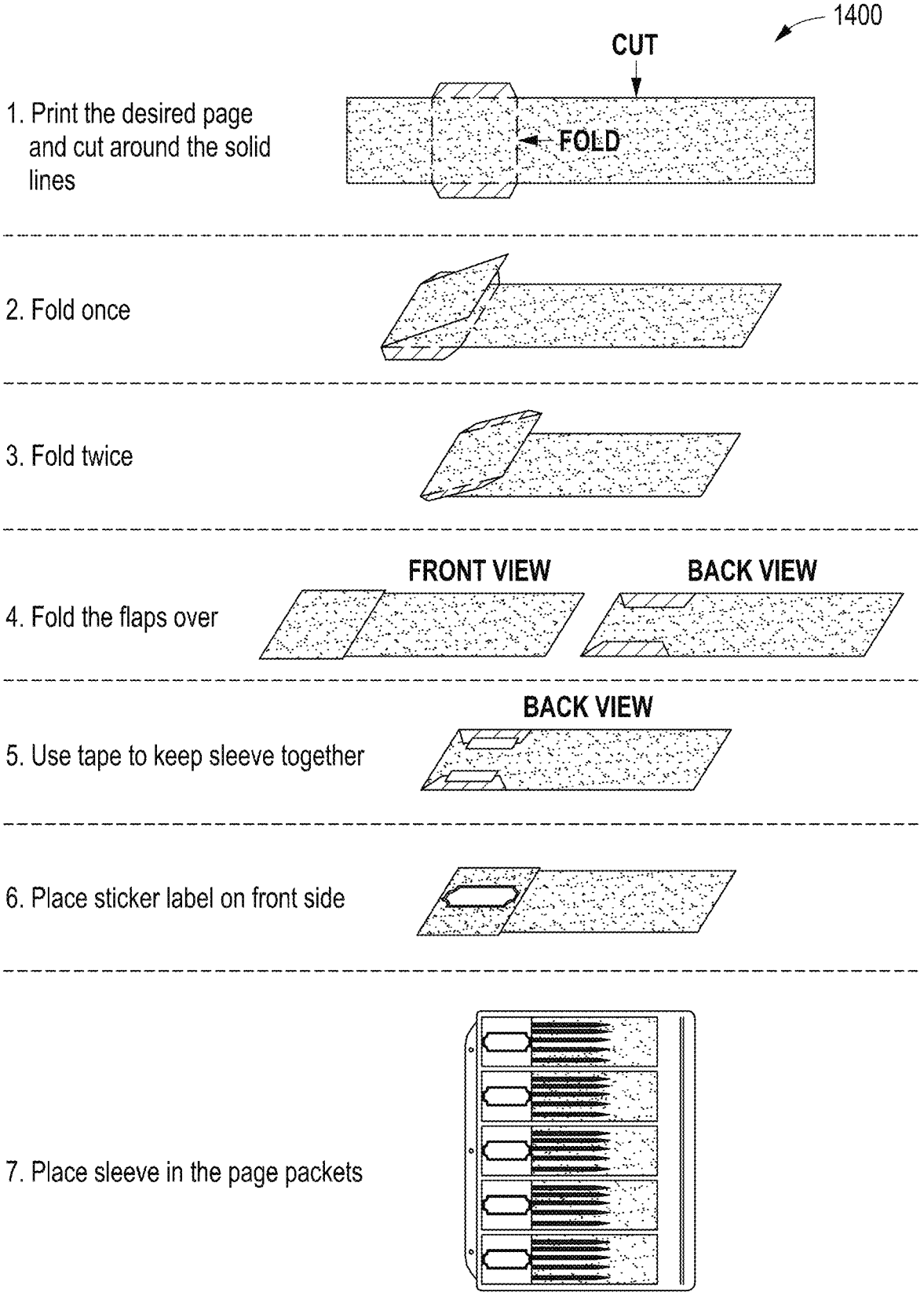

FIG. 15 illustrates instructions for preparing the craftwork tool and notion storage kit, in accordance with one embodiment.

In certain embodiments, the proportions shown in any of FIGS. 1-15 are drawn to scale. In other embodiments, the proportions shown in any of FIGS. 1-15 are relative dimensions only.

DETAILED DESCRIPTION

The present disclosure relates generally to kits for storing and organizing craftwork tools and notions, and methods relating thereto, particularly tools and notions used in sewing and needlework, and methods relating thereto.

The present disclosure provides craftwork tool and notion storage kits of the present disclosure are suitable for storing and organizing craftwork tools and notions.

Definitions

As used herein, the term "craftwork" generally refers to work traditionally performed by hand which exhibits individuality and artistry. Suitable examples of craftwork include sewing, mending, knitting, crocheting, quilting, embroidery, painting, general crafting (e.g., jewelry making, soap making, candle making, toy making, pottery, scrapbooking), and the like. Craftwork materials may include textiles, leather, wood, paper, canvas, plant fibers, clay, wax, metal, bone, horn, glass, stone, and the like.

As used herein, the term "craftwork tool" generally refers to larger items used during the craftwork process, while the term "craftwork notion" generally refers to smaller items used during the craftwork process or used as accessories in the craft making process. Suitable examples of craftwork tools and notions include crochet hooks (e.g., steel crochet hooks or regular crochet hooks), fixed circular knitting needles ("fixed circulars"), double pointed knitting needles ("double points"), interchangeable knitting needles and/or cords ("interchangeables"), straight needles, sewing needles, quilting needles, sewing machine needles, embroidery needles, stitch markers, dressmaking pins, quilting pins, threader, seam rippers, scissors, shears, clippers, rotary cutter, sewing gauge, rulers, tape measure, tracing wheel, sewing thread or yarn, quilting thread, embroidery thread, embroidery hoops, thimbles, bobbins, marking chalk, pencils, marking pens, buttons, snaps, hooks, zippers, beads, and craftwork patterns.

The size versus the length of a craftwork tool and/or notion may vary depending upon the type of the craftwork tool and/or the craftwork notion. As used herein, the size of a crochet hook or a knitting needle generally refers to the diameter of the shaft of the crochet hook or knitting needle, the length of a crochet hook or a knitting needle generally refers to the length of the shaft of the crochet hook or the knitting needle, while the length of an interchangeable cord generally refers the length of the cord. The size of a crochet hook, for example, may be referred to in English (i.e., in inches) and/or in metric (i.e., in millimeters), and/or may be assigned one or more corresponding letters and/or numbers in various geographic regions. Thus, a crochet hook size of "US 5/3.75 MM/UK 9", refers to a crochet hook having a 3.75-millimeter (mm) shaft diameter, corresponding to a US size 5 or a UK size 9 crochet hook.

Craftwork Tool and Notion Storage Kits

In one aspect, craftwork tool and notion storage kits ("kits") include: a plurality of stickers disposed on one or more sticker sheets; and one or more of the following: a plurality of inserts, and/or a plurality of insert patterns disposed on a top side of one or more insert pattern sheets, and/or a plurality of sleeves, and/or a plurality of sleeve patterns disposed on a top side of one or more sleeve pattern sheets.

Each insert and/or each sleeve may be sized to fit into one or more of a plurality of storage pockets of one or more transparent ring binder storage sheets. Each storage pocket may be sized to hold one or more craftwork tools and/or notions and one of the inserts and/or the sleeves, each inserted into the storage pocket via an opening of the storage pocket. Each sleeve may have one folded end forming a sleeve opening opposite to the folded end, where the sleeve is sized to hold the inserted end of one or more of the craftwork tools and/or the craftwork notions. Each craftwork tool and/or craftwork tool may be inserted into the sleeve via the sleeve opening when the sleeve opening has the same orientation as the storage pocket opening.

The plurality of stickers may include blank stickers, stickers each printed with one of a plurality of sizes of the craftwork tools and/or the craftwork notions, stickers each printed with one of a plurality of lengths of the craftwork tools and/or the craftwork notions, and/or stickers each printed with a plurality of types of the craftwork tools and/or the craftwork notions. The plurality of stickers may be sized to adhere to one or more of the following: the inserts and/or the sleeves, the one or more transparent ring binder storage sheets, one or more transparent or translucent envelopes sized to fit into one or more of the storage pockets and to hold one or more of the craftwork tools and/or the craftwork notions, and/or a ring binder sized to hold the one or more transparent ring binder storage sheets.

Kits of the present disclosure may further include one or more of the following: the ring binder, the one or more transparent ring binder storage sheets, one or more transparent or translucent envelopes, one or more blank pattern sheets, pens and/or markers, adhesive tape (e.g., washi tape), and a ruler. Kits of the present disclosure may further include instructions for preparing the plurality of inserts and/or the plurality of sleeves from the one or more insert patterns and/or the one or more sleeve patterns. Kits of the present disclosure may further include a digital file including a graphic image of the plurality of insert patterns, the digital file configured for printing the plurality of insert patterns onto one or more blank sleeve pattern sheets, and/or a digital file including a graphic image of the plurality of sleeve patterns, the digital file configured for printing the plurality of sleeve patterns onto one or more blank sleeve pattern sheets.

Figure 1:
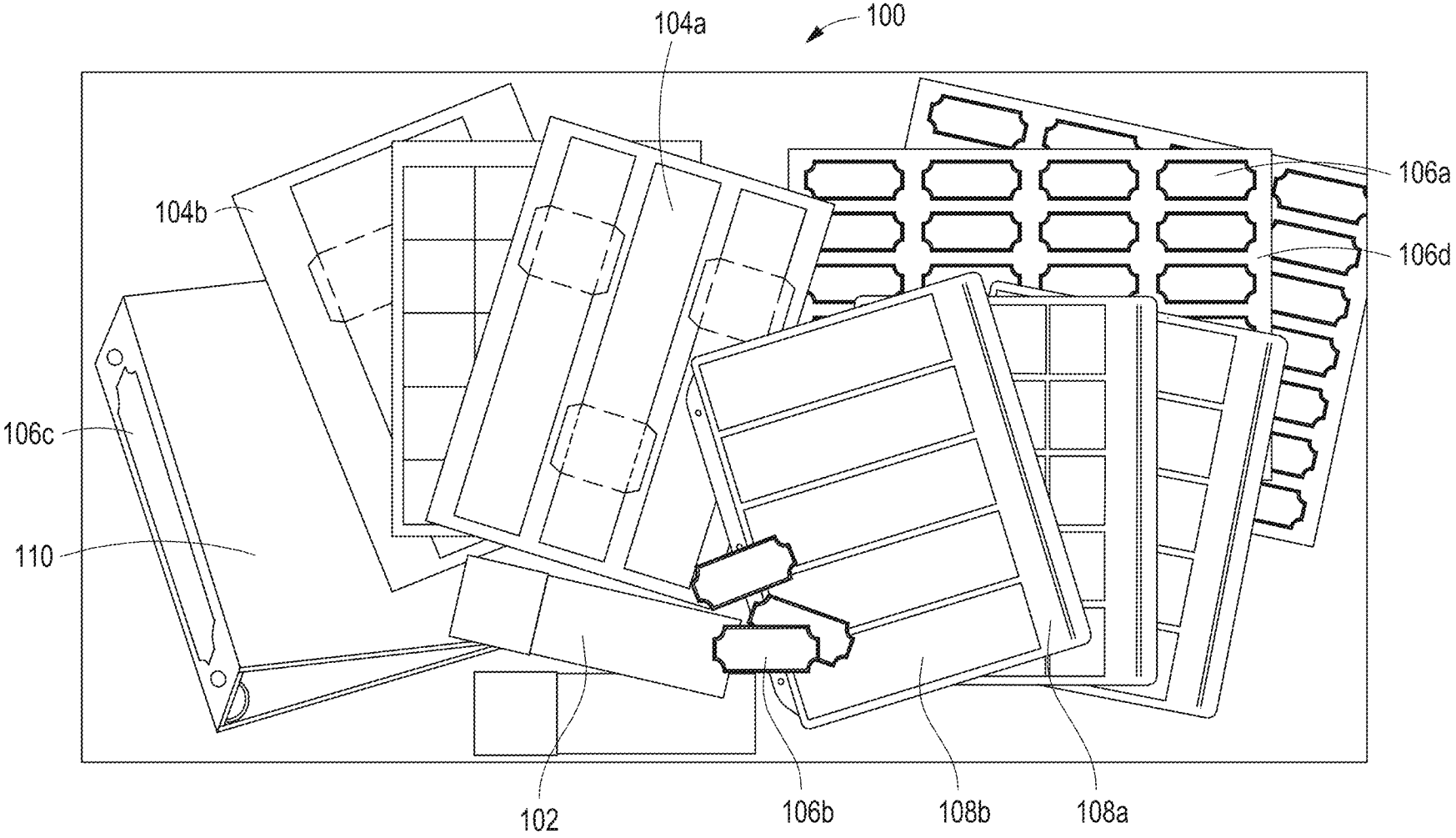
FIG. 1 illustrates a craftwork tool and notion storage kit, in accordance with one embodiment.

FIG. 1 illustrates the craftwork tool and notion storage kit 100 may comprise: one or more sleeves 102 and/or one or more sleeve patterns 104*a* disposed on one or more sleeve pattern sheets 104*b*; one or more blank stickers 106*a* and/or stickers printed with the size and/or the length of a craftwork tool or a craftwork notion 106*b* and/or stickers printed with a type of a craftwork tool or a craftwork notion 106*c*, disposed on one or more sticker sheets 106*d*; one or more transparent ring binder storage sheets 108*a* each containing one or more storage pockets 108*b*; a ring binder 110; and one or more inserts (not shown) and/or one or more insert patterns 112*a* disposed on one or more insert pattern sheets 112*b*.

Individual components of kits of the present disclosure may be provided together or separately. Kits of the present disclosure may be provided fully assembled, partially assembled, or may require assembly.

Flat Craftwork Tool and Notion Storage Pocket Inserts ("Inserts")

Kits of the present disclosure may include individual inserts, and/or a plurality of insert patterns for the plurality of inserts disposed on a top side of one or more insert pattern sheets, and/or a digital file including a graphic image of the plurality of insert patterns, the digital file configured for printing the plurality of insert patterns onto one or more blank insert pattern sheets. Stickers may be used to label the inserts, such as blank stickers or stickers printed with a size, length, and/or type of a craftwork tool and/or a craftwork notion, such as fixed circular knitting needles, to make it easier to put a craftwork tool and/or a craftwork notion back in the same storage pocket after use. Inserts may be sized to fit into smaller storage pockets, such as, for example, the storage pockets of a 9-storage pocket or a 20-storage pocket transparent ring binder storage sheet.

The plurality of insert patterns may include one or more predetermined perforated areas, and/or one or more predetermined folding areas. In one embodiment, a plurality of insert patterns are disposed on a top side of one or more insert pattern sheets, where the insert patterns include one or more predetermined perforated areas which include one or more perforated lines, such as dashed perforated lines, for removing each insert pattern from the insert pattern sheet by tearing the perforated lines.

A digital file of a graphic image of a plurality of insert patterns may be used to print the plurality of insert patterns onto one or more blank insert pattern sheets. The printed plurality of insert patterns may include one or more predetermined cutting areas in place of the one or more predetermined perforated areas which include one or more cutting lines, optionally solid cutting lines, for removing each insert pattern from the insert pattern sheet by cutting the cutting lines.

The shape and size of the each of the plurality of inserts and the plurality of insert patterns thereof corresponds to the shape of the storage pockets of one or more transparent storage sheets, such that each insert pattern has a rectangular shape bordered by the predetermined perforating or the predetermined cutting areas of the insert pattern, the rectangular shape slightly smaller than the size of the storage pockets.

Folded Craftwork Tool and Notion Storage Pocket Sleeves ("Sleeves")

Kits of the present disclosure may include individual sleeves, and/or a plurality of sleeve patterns for the plurality of sleeves disposed on a top side of one or more sleeve pattern sheets, and/or a graphic image of the plurality of sleeve patterns, the digital file configured for printing the plurality of sleeve patterns onto one or more blank sleeve pattern sheets. Exemplary sleeves suitable for inserting into storage pockets of transparent ring binder storage sheets and further suitable for containing inserted craftwork tools are illustrated in FIG. 2 and FIG. 3.

Sleeves act like a drawer for craftwork tools and/or notions inserted into a storage pocket. Stickers, whether blank or printed with a size, length, and/or type of craftwork tool and/or notion, may be used to label the sleeves to make it easier to put a craftwork tool and/or a craftwork notion back in the same sleeve after use. Sleeves are particularly useful for accessing craftwork tools and/or notions that are difficult to reach once inserted into the storage pockets, such as crochet hooks, interchangeable needle tips, or scissors. Sleeves may be sized to fit into various sizes of storage pockets, such as larger storage pockets (e.g., single storage pocket transparent ring binder storage sheets) or smaller storage pockets (e.g., 5-storage pocket transparent ring binder storage sheets). Depending upon the size of the storage pockets and the corresponding sleeves, each pocket may hold, for example, upwards of 15 knitting needles or crochet hooks comfortably.

Figure 2:
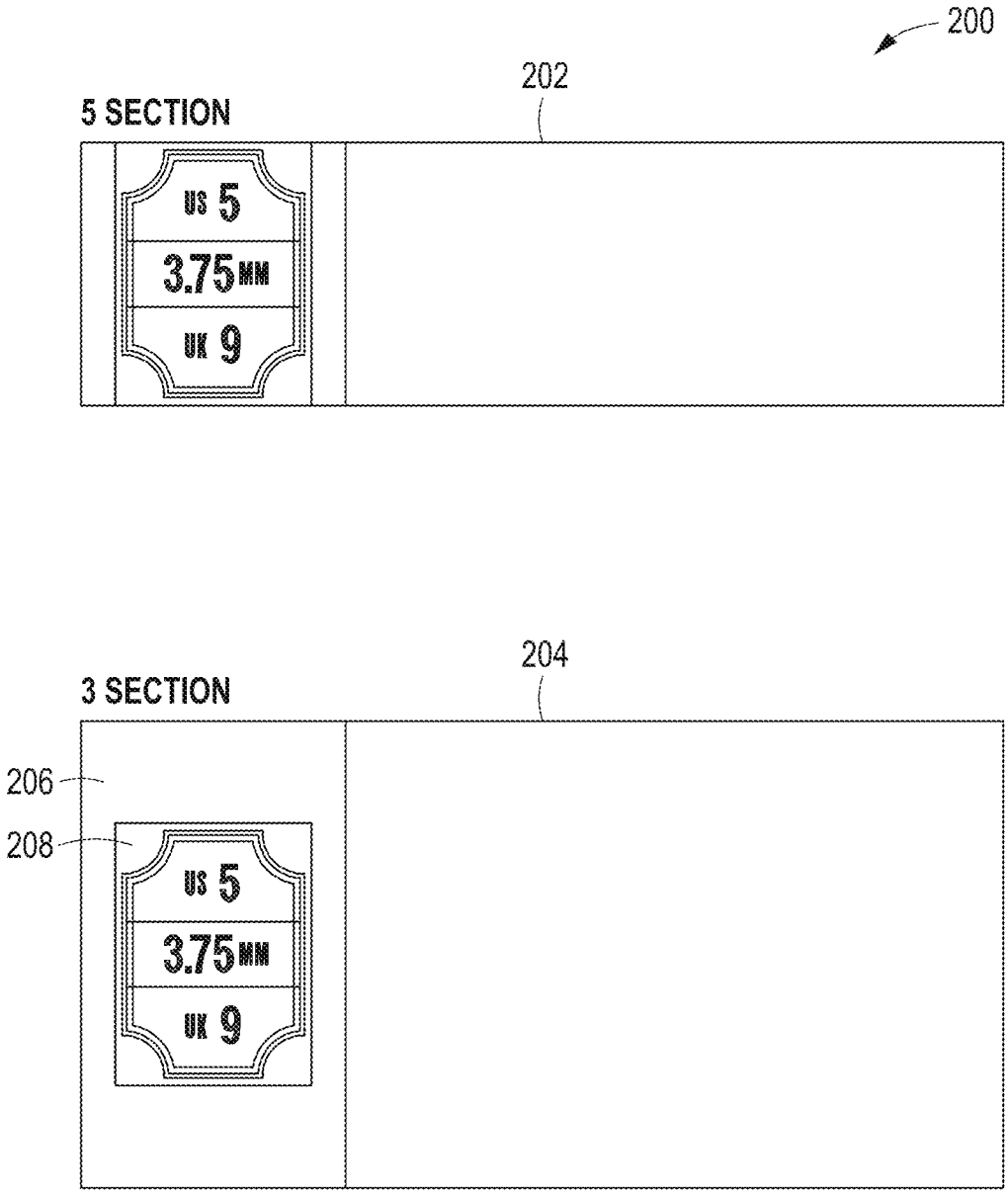
FIG. 2 illustrates various sleeves, each sized to fit into a transparent ring binder storage sheet having either 3 or 5 storage pockets, each sleeve having a sticker adhered onto the sleeve opening thereof, each sticker printed with a size of a craftwork tool or a craftwork notion, in accordance with one embodiment.
Figure 3:
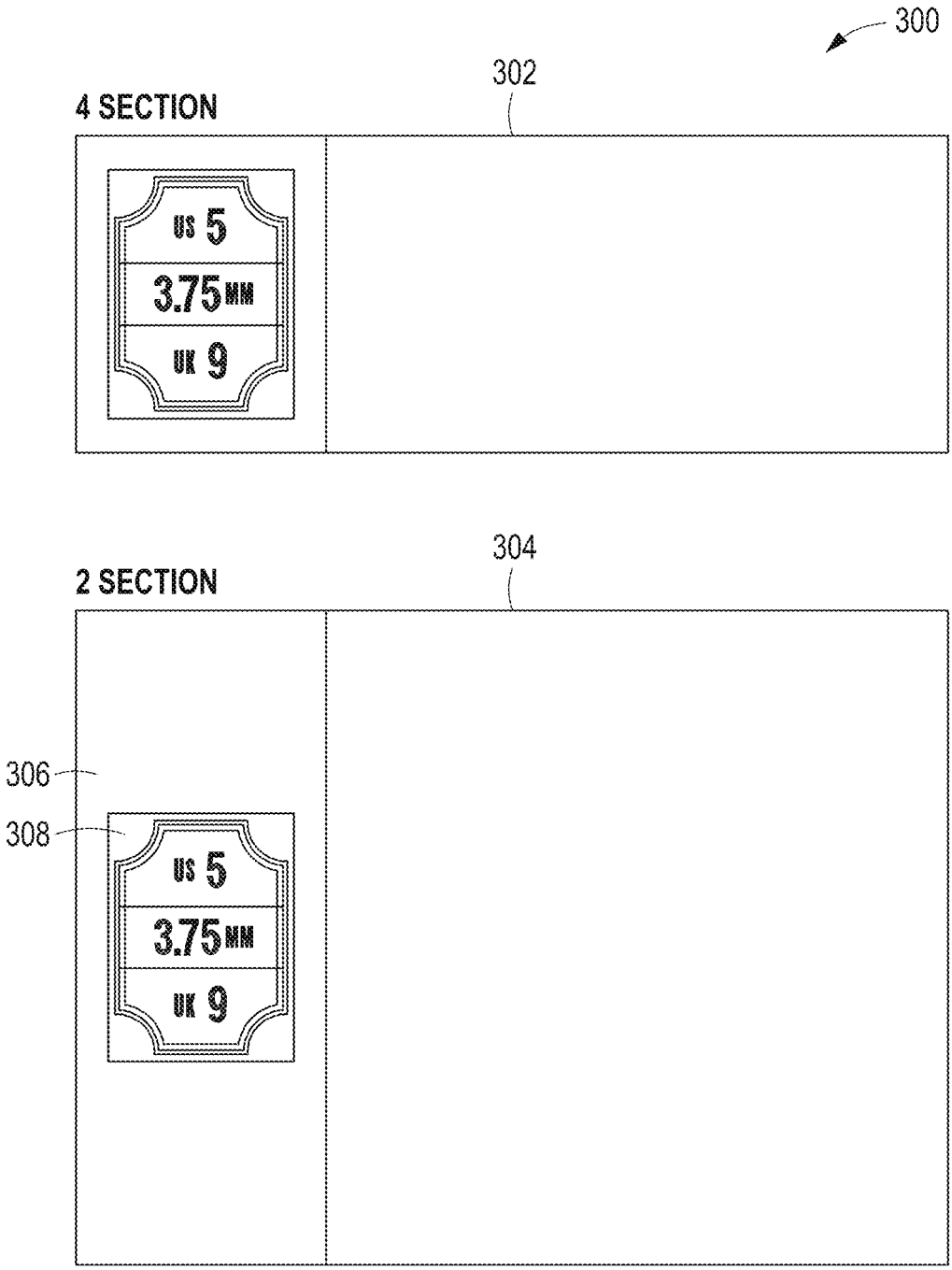
FIG. 3 illustrates various sleeves, each sized to fit into a transparent ring binder storage sheet having either 2 or 4 rectangular storage pockets, each sleeve having a sticker adhered onto the sleeve opening thereof, each sticker printed with a size of a craftwork tool or a craftwork notion, in accordance with one embodiment.

FIG. 2 illustrates a plurality of sleeves 200 comprising at least one sleeve 202 sized to fit into a transparent ring binder storage sheet having 5 storage pockets and/or at least one sleeve 204 sized to fit into a transparent ring binder storage sheet having 3 storage pockets, each sleeve having a sleeve opening 206 upon which a sticker 208 printed with the size and/or the length of a craftwork tool or a craftwork notion may be adhered. FIG. 3 illustrates a plurality of sleeves 300 comprising at least one sleeve 302 sized to fit into a transparent ring binder storage sheet having 4 storage pockets and/or at least one sleeve 304 sized to fit into a transparent ring binder storage sheet having 2 storage pockets, each sleeve having a sleeve opening 306 upon which a sticker printed with the size of a craft tool or a craft notion 308 may be adhered.

Sleeve pattern sheets for the sleeves may have one or more sleeve patterns per page. For example, three sleeve patterns may be provided per sleeve pattern sheet which fit the storage pockets of a 5-storage pocket transparent ring binder storage sheet. Two sleeve patterns may be provided per sleeve pattern sheet which fit the storage pockets of a 3- or 4-storage pocket transparent ring binder storage sheet. A single sleeve pattern may be provided per sleeve pattern sheet which fits a 2-storage pocket transparent ring binder storage sheet.

Exemplary sleeve patterns disposed on the top side of various sleeve pattern sheets are illustrated in FIG. 4, FIG. 5, FIG. 6, and FIG. 7. FIG. 4 illustrates one or more sleeve pattern sheets 400, upon which are disposed one or more sleeve patterns 402 sized to fit into a transparent ring binder storage sheet having 5 storage pockets, each sleeve pattern 400 comprising one or more cutting lines 404, and one or more folding lines 406. FIG. 5 illustrates one or more sleeve pattern sheets 500, upon which are disposed one or more sleeve patterns 502 sized to fit into a transparent ring binder storage sheet having 4 storage pockets, each sleeve pattern 502 comprising one or more cutting lines 504, and one or more folding lines 506. FIG. 6 illustrates one or more sleeve pattern sheets 600, upon which are disposed one or more sleeve patterns 602 sized to fit into a transparent ring binder storage sheet having 3 storage pockets, each sleeve pattern 602 comprising one or more cutting lines 604, and one or more folding lines 606. FIG. 7 illustrates one or more sleeve pattern sheets 700, upon which are disposed one or more sleeve patterns 702 sleeve sized to fit into a transparent ring binder storage sheet having 1 storage pocket, each sleeve pattern 702 comprising one or more cutting lines 704, and one or more folding lines 706.

Each sleeve pattern disposed on one or more sleeve pattern sheets or printed on one or more blank sleeve pattern sheets may include one or more predetermined cutting areas which include one or more cutting lines, such as solid cutting lines, for cutting a sleeve pattern out of a sleeve pattern sheet, and one or more predetermined folding areas which include one or more folding lines, such as dashed folding lines, for assembling a sleeve opening on a cut sleeve pattern.

FIG. 13 illustrates a schematic for folding the predetermined folding areas of a cut sleeve pattern 1300 which includes a length and a width, where the length has a first end 1304, a center 1306, and a second end 1308, and where the predetermined folding areas include a first folding line 1310 adjacent to the first end 1304 and extending across the width, a second folding line 1312 between the first folding line 1310 and the center 1306 and extending across the width, a third folding line 1314 and a fourth folding line 1316 parallel to and separated from one another by the width, and perpendicular to and extending from the first folding line 1310 to the second folding line 1312, and each defining a flap (flap 1318 adjacent to third folding line 1314, and flap 1320 adjacent to fourth folding line 1316, respectively) formed by an adjacent area of the sleeve pattern.

The shape and size of each of the plurality of sleeves and the plurality of sleeve patterns thereof corresponds to the shape of the storage pockets of one or more transparent storage sheets, such that each sleeve pattern has a rectangular shape bordered by the predetermined cutting areas of the sleeve pattern, the rectangular shape slightly smaller than the size of the storage pockets.

It is envisioned that any predetermined cutting areas of any sleeve pattern disposed on a top side of any sleeve pattern sheet may instead be predetermined perforated areas which include one or more perforated lines, such as dashed perforated lines, for removing each sleeve pattern from the sleeve pattern sheet by tearing the perforated lines.

Stickers

Kits of the present disclosure may also include a plurality of stickers disposed on one or more sticker sheets. A plurality of stickers may include blank stickers, stickers each printed with one of a plurality of sizes of the craftwork tools and/or the craftwork notions, stickers each printed with one of a plurality of lengths of the craftwork tools and/or the craftwork notions, and/or stickers each printed with a plurality of types of the craftwork tools and/or the craftwork notions. A plurality of stickers may be made from craft paper, such as 100% recycled and recyclable and/or uncoated Kraft paper or other types of sturdy paper.

Kits of the present disclosure may include stickers belonging to multiple categories of craftwork tools and/or notions or, alternatively, may include stickers belonging to a single category of craftwork tools and/or notions. Suitable example categories of craftwork tools or notions may include, but are not limited to, "Knitting," "Interchangeables," "Notions," "Crochet," "Embroidery," "Circulars," "Mending," "Double Points,", or "Straights". Stickers belonging to a category of craftwork tools and/or notions may be sized to adhere to the spine of a ring binder. Suitable examples of sticker labels printed on stickers sized to adhere to the spine of a ring binder may include, but are not limited to, "Interchangeable Tools," "Embroidery Tools," "Embroidery Thread," "Mending Tools," "Mending Yarns," "Bobbins," "Double Points," "Notions," "Fixed Circulars," "Crochet Hooks," and "Straight Needles."

A plurality of stickers may be sized to adhere to one or more of the following: the inserts and/or the sleeves, transparent or translucent envelopes sized to fit into one or more of the storage pockets and to hold one or more of the craftwork tools and/or the craftwork notions, and/or a ring binder sized to hold the one or more transparent ring binder storage sheets. By adhering one or more of the plurality of stickers on the inserts and/or the sleeves and/or the transparent or translucent envelopes, the transparent ring binder storage sheets remain clear and available for reorganization and reuse. A used sticker may be removed and reapplied with an adhesive such as adhesive tape (e.g., washi tape) or glue.

For steel crochet hooks, suitable sizes for printing on stickers may include but are not limited to 0.6 mm to about 3.5 mm. For regular crochet hooks, suitable sizes for printing on stickers may include but are not limited to 2.25 mm to 30 mm. For knitting needles, suitable sizes for printing on stickers may include but are not limited to US 000/1.5 mm to US 19/15 mm. For fixed circulars, suitable sizes for printing on stickers may include but are not limited to 9 inches (in)/23 centimeters (cm) to 60 in/150 cm. For interchangeable cables, suitable lengths for printing on stickers may include but are not limited to 5 cm/2 in to 200 cm/180 in.

Exemplary stickers, either blank or printed with a plurality of types of the craftwork tools and/or the craftwork notions and sized to fit and to adhere to a spine of a ring binder are illustrated in FIG. 8 and FIG. 9. FIG. 8 illustrates a sticker sheet 800 upon which is disposed a plurality of stickers, each sticker 802 having an area 804 printed with a type of a craftwork tool or a craftwork notion or left blank. FIG. 9 illustrates sticker sheet 900 upon which is disposed a plurality of stickers, each sticker 902 having an area 904 printed with a type of a craftwork tool or a craftwork notion or left blank.

Instructions

Kits of the present disclosure may also include instructions for preparing the plurality of inserts and/or the plurality of sleeves from the plurality of insert patterns and/or the plurality of sleeve patterns. Kits may include instructions for preparing the plurality of inserts, including the steps of: optionally, providing the digital file comprising a graphic image of the plurality of insert patterns, the digital file configured for printing the plurality of insert patterns onto one or more blank insert pattern sheets, and printing the graphic image of the plurality of insert patterns from the digital file thereof onto one side of one or more blank insert pattern sheets; and perforating the predetermined perforated areas and/or cutting the predetermined cutting areas of each insert pattern.

Kits may include instructions for preparing the plurality of sleeves, including the steps of: optionally, providing a digital file comprising a graphic image of the plurality of sleeve patterns, the digital file configured for printing the plurality of sleeve patterns onto one or more blank sleeve pattern sheets, and printing the plurality of sleeve patterns on one side of one or more blank sleeve pattern sheets, cutting the predetermined cutting areas of each sleeve pattern to form a plurality of cut sleeve patterns, folding the predetermined folding areas of each cut pattern to form the sleeve opening on a top side of each of the cut patterns, and adhering the sleeve opening of each cut pattern to the cut pattern, optionally, using tape, glue, or any combination thereof, to form the plurality of sleeves. Kits may also include instructions for folding the predetermined folding areas of each cut sleeve pattern, including the steps of: folding the first end of each cut sleeve pattern at the first folding line toward the second folding line, to form a once-folded first end on a top side of the cut pattern, folding the once-folded first end of each cut sleeve pattern at the second folding line toward the center, to form a twice-folded first end on the top side of the cut pattern, and folding the flap adjacent to each of the third folding line and the fourth folding line of each cut sleeve pattern toward the bottom side, to form the sleeve opening on the top side of each cut sleeve pattern.

Kits may further include instructions for performing one or more of the following steps: adhering one or more of the stickers onto one or more of the inserts and/or the sleeves, one or more of the transparent or translucent envelopes, if present, and/or the ring binder, if present, inserting one or more of the inserts and/or the sleeves into one or more of the storage pockets, such that the sleeve openings of the sleeves, if present, have the same orientation as the storage pocket openings, inserting one or more of the transparent or translucent envelopes into one or more of the storage pockets, inserting the one or more transparent ring binder storage sheets containing one or more of the inserts and/or the sleeves, and/or the transparent or translucent envelopes, if present, into the ring binder, if present, and inserting one or more of the craftwork tools and/or the craftwork notions into one or more of the storage pockets.

Instructions for preparing the craftwork tool and notion storage kit and/or instructions for folding the predetermined folding areas may include descriptive text and/or images describing each step thereof. Exemplary instructions for preparing the craftwork tool and notion storage kit are illustrated in FIG. 15.

Transparent Ring Binder Storage Sheets

Kits of the present disclosure may include one or more transparent ring binder storage sheets. Transparent ring binder storage sheets may include a plurality of rectangular storage pockets. The storage pockets of the transparent ring binder storage sheets may have openings at the top or a side of the transparent ring binder storage sheet. Transparent ring binder storage sheets may include a single rectangular storage pocket or a plurality of rectangular storage pockets, such as two, three, four, or five (e.g., suitable for sleeves) or such as nine or twenty (e.g., suitable for inserts or transparent or translucent envelopes). The storage pockets of the transparent ring binder storage sheets may have flaps or zipper to enclose small craftwork tools and/or notions within the storage pockets, such as bobbins or buttons. Transparent ring binder storage sheets may include a single rectangular storage pocket with a top opening with a zipper, to enclose larger craftwork tools and/or notions within the storage pocket, such as rulers or embroidery hoops or craftwork patterns. Transparent ring binder storage sheets may be made of heavy gauge vinyl. The storage pockets may be stuck together prior to use, and a craftwork tool may be used to separate the inner sides of the storage pocket prior to inserting an insert, a sleeve, a transparent or translucent envelope, or a craftwork tool or a craftwork notion inside the storage pocket.

Kits of the present disclosure may be emptied and refilled or reorganized by removing the craftwork tools and/or notions or the transparent or translucent envelopes from the storage pockets prior to removing the inserts from the transparent or translucent envelopes or the sleeves from the storage pockets.

Ring Binder

Kits of the present disclosure may include a ring binder. The ring binder may include at least two rings. The ring binder may have a spine printed with an outline corresponding to the shape of one of the plurality of stickers, such as a sticker printed with a type of a craftwork tool or a craftwork notion. A ring binder may be made of craft paperboard, such as Kraft paperboard or other types of sturdy paperboard, such as 100% recycled and recyclable and/or uncoated Kraft paperboard. An exemplary example of a ring binder is illustrated in FIG. 10. FIG. 10 illustrates a ring binder 1000 having each of a front cover 1002, a spine 1004, and a back cover 1006. One of the plurality of stickers printed with a type of a craftwork tool or a craftwork notion 1008 may be adhered to the spine 1004. The ring binder may have various measurements, defined by a binder height 1010, a cover width 1012, a spine width 1014, and a total width of front cover, spine, and back cover 1016.

In one embodiment, a kit may include multiple binders including, for example, a binder labeled "Crochet" for storing crochet hooks and or other related items, a binder labeled "Circulars" for storing circular knitting needles or other related items, a binder labeled "Knitting" for storing steel or regular knitting needles or other related items, and a binder labelled "Interchangeables" for storing interchangeable knitting needles, cables, or other related items.

Transparent or Translucent Envelopes

Kits of the present disclosure may include one or more transparent or translucent envelopes. Transparent or translucent envelopes may be sized to contain one or more small craftwork tools and/or notions, such as stitch markers, which allows a user to visually determine the contents of the envelopes without opening the envelopes. Transparent or translucent envelopes may be sized to fit into smaller storage pockets, such as the storage pockets of a 9-storage pocket transparent ring binder storage sheet. The inserts and the transparent or translucent envelopes may each be sized to fit into the storage pockets of the same transparent ring binder storage sheet. The transparent or translucent envelopes may be labeled with a sticker visible through the storage pocket, making it easier to put a craftwork tool and/or a craftwork notion back into the proper transparent or translucent envelope after use. Transparent or translucent envelopes may be made of glassine paper.

Pattern Sheets

Kits of the present disclosure may include one or more insert pattern sheets, one or more sleeve pattern sheets, and/or one or more blank pattern sheets. The insert pattern sheets, sleeve pattern sheets, and/or the blank pattern sheets may be made of heavy cardstock, optionally recycled heavy card stock.

Method for Preparing Kits of the Present Disclosure

In one aspect, methods for preparing a craftwork tool and notion storage kit include: providing the plurality of stickers disposed on the one or more sticker sheets; providing: the plurality of inserts and/or the plurality of insert patterns disposed on the top side of the one or more insert pattern sheets; the plurality of sleeves and/or the plurality of sleeve patterns disposed on the top side of the one or more sleeve pattern sheets; preparing one or more of the sleeves using the plurality of sleeve patterns, if present; and adhering one or more of the plurality of stickers onto: one or more of the inserts and/or the sleeves, one or more of the transparent ring binder storage sheets, if present, one or more of the transparent or translucent envelopes, if present, and the ring binder, if present.

Methods may further include providing the plurality of sleeve patterns, comprising: optionally, providing the digital file comprising the graphic image of the plurality of sleeve patterns, the digital file configured for printing the plurality of sleeve patterns onto one or more blank sleeve pattern sheets, and printing the graphic image of the plurality of sleeve patterns from the digital file thereof onto a top side of one or more blank sleeve pattern sheets. Methods may further include preparing the plurality of sleeves according to method 1100 of FIG. 11 and method 1200 of FIG. 12 and illustrated in schematics 1300, 1400, and 1500 of FIG. 13, FIG. 14, and FIG. 15, respectively. FIG. 11 illustrates an example flowchart 1100 for preparing the craftwork tool and notion storage kit 100 from a plurality of sleeve patterns. Although the example flowchart 1100 depicts a particular sequence of operations, the sequence may be altered without departing from the scope of the present disclosure. For example, some of the operations depicted may be performed in parallel or in a different sequence that does not materially affect the function of the flowchart 100. In other examples, different components of, or steps of preparing, craftwork tool and notion storage kit 100 may perform functions at substantially the same time or in a specific sequence. Methods may include providing a plurality of sleeve patterns for a plurality of sleeves, the plurality of sleeve patterns disposed on a top side of one or more sleeve pattern sheets at step 1102. Methods may further include cutting one or more predetermined cutting areas disposed on a top side of each of the plurality of sleeve patterns to cut each of the plurality of sleeve patterns from the plurality of sleeve pattern sheets at step 1104. Methods may further include folding one or more predetermined folding areas disposed on a top side of each of the plurality of cut sleeve patterns to form a sleeve opening on the top side of each of the plurality of cut sleeve patterns at step 1106. Methods may include adhering the sleeve opening of each of the plurality of cut sleeve patterns to a bottom side of each of the plurality of cut sleeve patterns to form the plurality of sleeves at step 1108.

FIG. 12 illustrates an example flowchart 1200 for folding the predetermined folding areas of a cut sleeve pattern. Although the example flowchart 1200 depicts a particular sequence of operations, the sequence may be altered without departing from the scope of the present disclosure. For example, some of the operations depicted may be performed in parallel or in a different sequence that does not materially affect the function of the flowchart 1200. In other examples, different components of, or steps of preparing, craftwork tool and notion storage kit 100 may perform functions at substantially the same time or in a specific sequence. Methods may include folding a first end 1210 of a cut sleeve pattern 1200 at a first folding line 1212 adjacent to the first end 1210 toward a second folding line 1214 adjacent to a center 1216 to form a once-folded first end 1218 on the top side 1220 of the cut sleeve pattern at step 1202. Methods may include folding the once-folded first end 1218 of the cut sleeve pattern 1200 at the second folding line 1214 toward the center 1216, to form a twice-folded first end 1222 on the top side 1220 of the cut sleeve pattern 1200; and at step 1204. Methods may include folding a flap 1224 adjacent to a third folding line 1226 and a flap 1228 adjacent to a fourth folding line 1230 toward the bottom side 1232 of the cut sleeve pattern 1200, to form a sleeve opening 1234 on the top side 1220 of the cut sleeve pattern 1200 at step 1206.

FIG. 13 illustrates a schematic 1300 for folding the predetermined folding areas disposed on a top side 1322 of a cut sleeve pattern 1302 having a first end 1304, a center 1306, and a second end 1308. Folding the predetermined folding areas includes folding the first end 1304 of the cut sleeve pattern 1302 at a first folding line 1310 adjacent to the first end 1304 toward a second folding line 1312 adjacent to the center 1306, thereby forming a once-folded first end 1324. Folding the predetermined folding areas further includes folding the once-folded first end 1324 at the second folding line 1312 toward the center 1306, thereby forming a twice-folded first end 1326. Folding the predetermined folding areas further includes folding the flap 1318 at the adjacent third folding line 1314 and the flap 1320 at the fourth folding line 1316 each toward the bottom of the cut pattern 1330, thereby forming a sleeve opening 1328 on the top of the cut pattern 1322.

FIG. 14 illustrates a schematic 1400 for preparing the craftwork tool and notion storage kit 100 from folded and cut sleeve patterns. FIG. 14 illustrates how a flap 1402 may be adhered by an adhesive 1404, such as adhesive tape (e.g., washi tape) to a bottom side of cut sleeve pattern 1406. Methods may further include adhering one or more of the plurality of stickers by: adhering the blank sticker or the sticker printed with the size and/or length of one of the craftwork tools or one of the craftwork notions onto at least one of the inserts and/or sleeves, and/or adhering the blank sticker or the sticker printed with the type of one of the craftwork tools or one of the craftwork notions onto the spine of the ring binder, if present. FIG. 14 illustrates how a sticker printed with the size and/or the length of a craftwork tool or a craftwork notion 1408 may be adhered to a sleeve opening 1410 on a top side 1412.

Methods of the present disclosure may further include providing the instructions for preparing the plurality of sleeves from the one or more sleeve patterns or the digital graphic file comprising the digital image thereof. FIG. 15 illustrates exemplary instructions for preparing the plurality of sleeves, the instructions including written description and schematic instructions.

Methods of the present disclosure may further include providing one or more of the following: the ring binder, the one or more transparent ring binder storage sheets, the one or more transparent or translucent envelopes, the one or more blank pattern sheets, the pens and/or markers, the adhesive tape (e.g., washi tape), and a ruler.

Methods may further include: inserting one or more of the inserts and/or the sleeves into one or more of the storage pockets, such that the sleeve openings of the sleeves, if present, have the same orientation as the storage pocket openings; inserting one or more of the transparent or translucent envelopes into one or more of the storage pockets; inserting the one or more transparent ring binder storage sheets containing one or more of the inserts and/or the sleeves, and/or the transparent or translucent envelopes, if present, into the ring binder, if present; and/or inserting one or more of the craftwork tools and/or the craftwork notions into one or more of the storage pockets. FIG. 14 illustrates how to insert a craftwork tool or craftwork notion 1418 into a transparent ring binder storage sheet 1414 having storage pocket openings 1416, where the inserted craftwork tool or craftwork notion 1418 is held in place by the sleeve openings 1410.

In one aspect, methods of preparing the plurality of sleeves include providing the plurality of sleeve patterns disposed on the top side of the one or more insert pattern sheets; cutting the predetermined cutting areas of each of the plurality of sleeve patterns to cut the sleeve patterns from the plurality of sleeve pattern sheets; folding the predetermined folding areas of each of the plurality of cut sleeve patterns to form the sleeve opening on a top side of each of the cut sleeve patterns; an adhering the sleeve opening of each of the plurality of cut sleeve patterns to a bottom side of each of the cut sleeve patterns, optionally, using tape, glue, or any combination thereof, to form the plurality of sleeves. Methods may further include: providing the plurality of stickers disposed on the one or more sticker sheets, and adhering one or more of the plurality of stickers onto one or more of the following: one or more of the sleeves, one or more of the transparent ring binder storage sheets, one or more of the transparent or translucent envelopes, and the ring binder. Methods may further comprise: providing one or more of the following: the one or more transparent ring binder storage sheets; the transparent or translucent envelopes; and the ring binder; and performing one or more of the following steps: inserting one or more of the sleeves into one or more of the storage pockets, such that the sleeve openings of the sleeves have the same orientation as the storage pocket openings; inserting one or more of the transparent or translucent envelopes into one or more of the storage pockets; inserting into the ring binder one or more of the transparent ring binder storage sheets containing one or more of the sleeves and/or one or more of the transparent or translucent envelopes; and inserting one or more of the craftwork tools and/or the craftwork notions into one or more of the storage pockets.

When kits of the present disclosure further include the plurality of insert patterns or the digital file including the graphic image thereof, methods may also include: providing the plurality of insert patterns or the digital file including the graphic image thereof. Providing the plurality of insert patterns may include: providing a plurality of insert patterns disposed on the one or more insert pattern sheets, each insert pattern comprising the one or more predetermined perforated areas. Providing the plurality of insert patterns may include: printing the graphic image of the plurality if insert sleeves from the digital file thereof onto one side of one or more blank insert pattern sheets, each insert pattern comprising the one or more predetermined cutting areas. Methods may comprise preparing the plurality of inserts from the plurality of insert patterns. Preparing the plurality of inserts may comprise perforating the one or more predetermined perforated areas of the provided plurality of insert patterns or cutting the one or more predetermined cutting areas of the printed plurality of insert pattern, to separate the insert patterns from the insert pattern sheet. Methods of the present disclosure may further include providing the instructions for preparing the plurality of inserts from the one or more insert patterns or the digital file comprising the graphic image thereof.

EXAMPLE EMBODIMENTS

The present disclosure is further directed to the following non-limiting embodiments.

Embodiment 1. A craftwork tool and notion storage kit comprising: a plurality of stickers disposed on one or more sticker sheets; a plurality of flat craftwork tool and notion storage pocket inserts ("inserts") and/or a plurality of patterns for the inserts disposed on a top side of one or more sheets ("insert pattern sheets"); and a plurality of folded craftwork tool and notion storage pocket sleeves ("sleeves") and/or a plurality of patterns for the plurality of sleeves ("sleeve patterns") disposed on a top side of one or more sheets ("sleeve pattern sheets"), wherein each insert and/or each sleeve is sized to fit into one or more of a plurality of storage pockets of one or more transparent ring binder storage sheets, wherein each storage pocket is sized to hold one or more craftwork tools and/or notions and one of the inserts and/or the sleeves, each inserted into the storage pocket via an opening of the storage pocket, wherein each sleeve has one folded end forming a sleeve opening opposite to the folded end, wherein the sleeve is sized to hold the inserted end of one or more of the craftwork tools and/or the craftwork notions, each craftwork tool and/or notion inserted into the sleeve via the sleeve opening when the sleeve opening has the same orientation as the storage pocket opening; wherein the plurality of stickers comprise blank stickers, stickers each printed with one of a plurality of sizes of the craftwork tools and/or the craftwork notions, and/or stickers each printed with a plurality of types of the craftwork tools and/or the craftwork notions, and wherein the plurality of stickers are sized to adhere to one or more of the following: the inserts and/or the sleeves, the transparent ring binder storage sheets, one or more transparent or translucent envelopes sized to fit into one or more of the storage pockets and to hold one or more of the craftwork tools and/or the craftwork notions, and/or a ring binder sized to hold the one or more transparent ring binder storage sheets.

Embodiment 2. The craftwork tool and notion storage kit of Embodiment 1, further comprising one or more of the following: the ring binder; one or more of the transparent ring binder storage sheets; one or more of the transparent or translucent envelopes; one or more blank pattern sheets; adhesive tape; one or more pens and/or markers; and a ruler.

Embodiment 3. The craftwork tool and notion storage kit storage kit of Embodiment 1 or Embodiment 2, wherein: each sleeve pattern comprises, disposed on a top side of the sleeve pattern: one or more predetermined cutting areas comprising one or more cutting lines, optionally one or more solid cutting lines, for cutting a sleeve pattern out of one of the sleeve pattern sheets; and one or more predetermined folding areas comprising one or more folding lines, optionally one or more dashed folding lines, for assembling a folded end of a cut sleeve pattern.

Embodiment 4. The craftwork tool and notion storage kit of Embodiment 3, wherein each sleeve pattern has a rectangular shape comprising a length and a width, wherein the length has a first end, a center, and a second end, and wherein the predetermined folding areas comprise: a first folding line adjacent to the first end and extending across the width; a second folding line between the first folding line and the center and extending across the width; a third folding line and a fourth folding line, each parallel to the other, and separated from the other by the width, and each perpendicular to and extending from the first folding line to the second folding line, and each defining a flap formed by an adjacent area of the pattern extending beyond the width.

Embodiment 5. The craftwork tool and notion storage kit of Embodiment 3 or Embodiment 4, wherein the craftwork tool and notion storage kit further comprises instructions for preparing the craftwork tool and notion storage kit, wherein preparing the craftwork tool and notion storage kit comprises performing one or more of the following steps: optionally, providing a digital file comprising a graphic image of the plurality of sleeve patterns, the digital file configured for printing the plurality of sleeve patterns onto one or more blank sleeve pattern sheets, and printing the graphic image of the plurality of sleeve patterns from the digital file thereof onto a top side of one or more blank sleeve pattern sheets; cutting the predetermined cutting areas of each sleeve pattern to form a plurality of cut sleeve patterns; folding the predetermined folding areas of each cut sleeve pattern to form the sleeve opening on the top side of each of the cut sleeve pattern; and adhering the sleeve opening of each cut sleeve pattern to a bottom side of the cut sleeve pattern, optionally, using tape, glue, or any combination thereof, to form the plurality of sleeves.

Embodiment 6. The craftwork tool and notion storage kit of Embodiment 5, wherein folding the predetermined folding areas of each cut sleeve pattern comprises performing one or more of the following steps: folding the first end of each cut sleeve pattern at the first folding line toward the second folding line, to form a once-folded first end on the top side of the cut sleeve pattern; folding the once-folded first end of each cut sleeve pattern at the second folding line toward the center, to form a twice-folded first end on the top side of the cut sleeve pattern; and folding the flap adjacent to each of the third folding line and the fourth folding line of each cut sleeve pattern toward the bottom side, to form the sleeve opening on the top side of each cut sleeve pattern.

Embodiment 7. The craftwork tool and notion storage kit of Embodiment 5 or Embodiment 6, wherein the preparing the craftwork tool and notion storage kit further comprise performing one or more of the following steps: adhering one or more of the stickers onto one or more of the following: one or more of the plurality of inserts; one or more of the plurality of sleeves; one or more of the transparent ring binder storage sheets; one or more of the transparent or translucent envelopes; and the ring binder; inserting one or more of the inserts and/or the sleeves into one or more of the storage pockets, such that the sleeve openings of the sleeves, if present, have the same orientation as the storage pocket openings; inserting one or more of the transparent or translucent envelopes into one or more of the storage pockets; inserting into the ring binder one or more of the transparent ring binder storage sheets containing one or more of the following: one or more of the inserts and/or the sleeves, and one or more of the transparent or translucent envelopes; and inserting one or more of the craftwork tools and/or the craftwork notions into one or more of the storage pockets.

Embodiment 8. The craftwork tool and notion storage kit of any one of Embodiments 1 to 7, wherein: the plurality of inserts and/or the plurality of sleeves are made from heavy cardstock, optionally recycled heavy card stock; the one or more transparent ring binder storage sheets are made from heavy gauge vinyl; the one or more transparent ring binder storage sheets each comprise one to five rectangular storage pockets; the transparent or translucent envelopes are made from glassine paper; the ring binder is made from Kraft paperboard; and/or the ring binder comprises at least two rings.

Embodiment 9. A method of preparing a craftwork tool and notion storage kit, comprising: providing a plurality of stickers disposed on one or more sticker sheets; a plurality of flat craftwork tool and notion storage pocket inserts ("inserts") and/or a plurality of insert patterns disposed on a top side of one or more sheets ("insert pattern sheets"); and a plurality of folded craftwork tool and notion storage pocket sleeves ("sleeves") and/or a plurality of patterns of the plurality of sleeves ("sleeve patterns") disposed on a top side of one or more sheets ("sleeve pattern sheets"); preparing one or more of the sleeves using the plurality of sleeve patterns, if present; and adhering one or more of the plurality of stickers onto one or more of the following: one or more of the inserts and/or the sleeves, one or more transparent ring binder storage sheets, one or more transparent or translucent envelopes, and a ring binder, wherein each insert and/or each sleeve is sized to fit into one or more of a plurality of storage pockets of the one or more transparent ring binder storage sheets, wherein each storage pocket is sized to hold one or more craftwork tools and/or notions and one of the inserts and/or the sleeves, each inserted into the storage pocket via a top opening or a side opening of the storage pocket, wherein each sleeve has one folded end forming a sleeve opening opposite to the folded end, wherein the sleeve is sized to hold the inserted end of one or more of the craftwork tools and/or the craftwork notions, each craftwork tool and/or notion inserted into the sleeve via the sleeve opening when the sleeve opening has the same orientation as the storage pocket opening; wherein the plurality of stickers comprise blank stickers, stickers each printed with one of a plurality of sizes of one or more craftwork tools and/or notions, and/or stickers each printed with a plurality of types of the craftwork tools and/or the craftwork notions; and wherein the plurality of stickers are sized to adhere to one or more of the following: the inserts and/or the sleeves, the transparent ring binder storage sheets, one or more transparent or translucent envelopes sized to fit into one or more of the storage pockets and to hold one or more of the craftwork tools and/or the craftwork notions, and/or a ring binder sized to hold the one or more transparent ring binder storage sheets.

Embodiment 10. The method of Embodiment 9, wherein: each sleeve pattern comprises, disposed on a top side of the sleeve pattern: one or more predetermined cutting areas comprising one or more cutting lines, optionally solid cutting lines, for cutting a sleeve pattern out of the sleeve pattern sheets; and one or more predetermined folding areas comprising one or more folding lines, optionally dashed folding lines, for assembling a folded end of a cut sleeve pattern.

Embodiment 11. The method of Embodiment 10, wherein each sleeve pattern has a rectangular shape comprising a length and a width, wherein the length has a first end, a center, and a second end, and wherein the predetermined folding areas comprise: a first folding line adjacent to the first end and extending across the width; a second folding line between the first folding line and the center and extending across the width; a third folding line and a fourth folding line, each parallel to the other, and separated from the other by the width, and each perpendicular to and extending from the first folding line to the second folding line, and each defining a flap formed by an adjacent area of the pattern extending beyond the width.

Embodiment 12. The method of Embodiment 10 or Embodiment 11, wherein preparing the plurality of sleeves comprises: optionally, providing a digital file comprising a graphic image of the plurality of sleeve patterns, the digital file configured for printing the plurality of sleeve patterns onto one or more blank sleeve pattern sheets, and printing the graphic image of the plurality of sleeve patterns from the digital file thereof onto a top side of one or more blank sleeve pattern sheets; cutting the predetermined cutting areas of each of the plurality of sleeve pattern to form a plurality of cut sleeve patterns; folding the predetermined folding areas of each of the plurality of cut sleeve patterns to form the sleeve opening on the top side of each of the plurality of cut sleeve patterns; and adhering the sleeve opening of each of the plurality of cut sleeve patterns to a bottom side of the each of the plurality of cut sleeve patterns, optionally, using tape, glue, or any combination thereof, to form the plurality of sleeves.

Embodiment 13. The method of any one of Embodiments 10 to 12, wherein folding the predetermined folding areas of each sleeve pattern comprises: folding the first end of each cut sleeve pattern at the first folding line toward the second folding line, to form a once-folded first end on the top side of the cut sleeve pattern; folding the once-folded first end of each cut sleeve pattern at the second folding line toward the center, to form a twice-folded first end on the top side of the cut sleeve pattern; and folding the flap adjacent to each of the third folding line and the fourth folding line of each cut sleeve pattern toward the bottom side, to form the sleeve opening on the top side of each cut sleeve pattern.

Embodiment 14. The method of any one of Embodiments 9 to 13, further comprising providing one or more of the following: the ring binder; one or more of the transparent ring binder storage sheets; one or more of the transparent or translucent envelopes; one or more blank pattern sheets; adhesive tape; one or more pens and/or markers; and a ruler.

Embodiment 15. The method of Embodiment 14, further comprising one or more of the following: inserting one or more of the transparent or translucent envelopes into one or more of the storage pockets; inserting into the ring binder one or more of the transparent ring binder storage sheets containing one or more of the inserts and/or the sleeves, and/or one or more of the transparent or translucent envelopes; and inserting one or more of the craftwork tools and/or the craftwork notions into one or more of the storage pockets.

Embodiment 16. The method of any one of Embodiments 9 to 15, wherein: the one or more insert pattern sheets and/or sleeve pattern sheets are heavy cardstock, optionally recycled heavy card stock; the one or more transparent ring binder storage sheets are heavy gauge vinyl transparent ring binder storage sheets; the transparent or translucent envelopes are glassine paper envelopes; the ring binder is a Kraft paperboard binder; the ring binder comprises at least two rings; and/or the plurality of storage pockets of one or more of the transparent ring binder storage sheets comprise two, three, four, or five rectangular storage pockets.

Embodiment 17. A method of preparing a plurality of sleeves, comprising: providing a plurality of folded craftwork tool and notion storage pocket sleeve patterns ("sleeve patterns") for a plurality of folded craftwork tool and notion storage pocket sleeves, wherein the plurality of sleeve patterns are disposed on a top side of one or more sleeve pattern sheets, cutting one or more predetermined cutting areas of each of the plurality of sleeve patterns to cut the plurality of sleeve patterns from the plurality of sleeve pattern sheets; folding one or more predetermined folding areas of each of the plurality of cut sleeve patterns to form a sleeve opening on a top side of each of the plurality of cut sleeve patterns; and adhering the sleeve opening of each of the plurality of cut sleeve patterns to a bottom side of each of the plurality of cut sleeve patterns, optionally, using tape, glue, or any combination thereof, to form the plurality of sleeves, optionally, wherein providing the plurality of sleeve patterns further comprises providing a digital file comprising a graphic image of the plurality of sleeve patterns and printing the graphic image onto one side of one or more blank sleeve pattern sheets, wherein each sleeve is sized to fit into one or more of a plurality of storage pockets of one or more transparent ring binder storage sheets, wherein each storage pocket is sized to hold one or more craftwork tools and/or notions and one of the sleeves, each inserted into the storage pocket via a top opening or a side opening of the storage pocket, and wherein each sleeve has one folded end forming a sleeve opening opposite to the folded end, wherein the sleeve is sized to hold the inserted end of one or more of the craftwork tools and/or notions, each craftwork tool and/or notion inserted into the sleeve via the sleeve opening when the sleeve opening has the same orientation as the storage pocket opening; and wherein each sleeve pattern comprises: the one or more predetermined cutting areas comprising one or more cutting lines, optionally solid cutting lines, for cutting the sleeve pattern out of one of the sleeve pattern sheets; and the one or more predetermined folding areas comprising one or more folding lines, optionally dashed folding lines, for assembling a folded end of the cut sleeve pattern.

Embodiment 18. The method of Embodiment 17, wherein folding one or more predetermined folding areas of each sleeve pattern to form a sleeve opening on a top side of each sleeve pattern comprises for each pattern: folding a first end of the cut sleeve pattern at a first folding line adjacent to the first end and extending across the width toward a second folding line between the first folding line and the center and extending across the width to form a once-folded first end on a top side of the cut sleeve pattern; folding the once-folded first end of the cut sleeve pattern at the second folding line toward the center, to form a twice-folded first end on the top side the cut sleeve pattern; and folding a flap adjacent to each of a third folding line and a fourth folding line of each cut sleeve pattern toward the bottom side, to form the sleeve opening on the top side of each cut sleeve pattern, wherein the third folding line and the fourth folding line are parallel to and separated from one another by the width, and perpendicular to and extending from the first folding line to the second folding line, and each defining the flap adjacent thereto extending beyond the width of the pattern.

Embodiment 19. The method of Embodiment 17 or Embodiment 18, further comprising: providing a plurality of stickers disposed on one or more sticker sheets, wherein the plurality of stickers comprise blank stickers, stickers each printed with one of a plurality of sizes of one or more craftwork tools and/or notions, and/or stickers each printed with a plurality of types of the craftwork tools and/or the craftwork notions; and wherein the plurality of stickers are sized to adhere to one or more of the following: the sleeves, the one or more transparent ring binder storage sheets, one or more transparent or translucent envelopes sized to fit into one or more of the storage pockets of the one or more transparent ring binder storage sheets and to hold one or more of the craftwork tools and/or the craftwork notions, and/or a ring binder sized to hold the one or more transparent ring binder storage sheets; and adhering one or more of the plurality of stickers onto one or more of the following: one or more of the sleeves, one or more of the transparent ring binder storage sheets, one or more of the transparent or translucent envelopes, and the ring binder.

Embodiment 20. The method of any one of Embodiments 17 to 19, providing one or more of the following: the one or more transparent ring binder storage sheets; and the ring binder; and performing one or more of the following steps: inserting one or more of the sleeves into one or more of the storage pockets, such that the sleeve openings of the sleeves have the same orientation as the storage pocket openings; inserting into the ring binder one or more of the transparent ring binder storage sheets containing one or more of the sleeves; and inserting one or more of the craftwork tools and/or the craftwork notions into one or more of the storage pockets.

Embodiment 21: A craftwork tool and notion storage kit comprising: a plurality of stickers disposed on one or more sticker sheets; and each of the following: a plurality of flat craftwork tool and notion storage pocket inserts ("inserts") and/or a plurality of insert patterns disposed on a top side of one or more sheets ("insert pattern sheets"); and a plurality of folded craftwork tool and notion storage pocket sleeves ("sleeves") and/or a plurality of patterns for the plurality of sleeves ("sleeve patterns") disposed on a top side of one or more sheets ("sleeve pattern sheets"); and a digital file comprising a graphic image of the plurality of sleeve patterns, the digital file configured for printing the plurality of sleeve patterns onto one or more blank sleeve pattern sheets, wherein each insert and/or each sleeve is sized to fit into one or more of a plurality of storage pockets of one or more transparent ring binder storage sheets, wherein each storage pocket is sized to hold one or more craftwork tools and/or notions and one of the inserts and/or the sleeves, each inserted into the storage pocket via an opening of the storage pocket, wherein each sleeve has one folded end forming a sleeve opening opposite to the folded end, wherein the sleeve is sized to hold the inserted end of one or more of the craftwork tools and/or the craftwork notions, each craftwork tool and/or notion inserted into the sleeve via the sleeve opening when the sleeve opening has the same orientation as the storage pocket opening; wherein the plurality of stickers comprise blank stickers, stickers each printed with one of a plurality of sizes of the craftwork tools and/or the craftwork notions, and/or stickers each printed with a plurality of types of the craftwork tools and/or the craftwork notions, and wherein the plurality of stickers are sized to adhere to one or more of the following: the inserts and/or the sleeves, the transparent ring binder storage sheets, one or more transparent or translucent envelopes sized to fit into one or more of the storage pockets and to hold one or more of the craftwork tools and/or the craftwork notions, and/or a ring binder sized to hold the one or more transparent ring binder storage sheets.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is not intended that the invention be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. A craftwork tool and notion storage kit comprising:

a plurality of stickers disposed on one or more sticker sheets;

a plurality of flat craftwork tool and notion storage pocket inserts and/or a plurality of insert patterns disposed on a top side of one or more insert pattern sheets; and a plurality of folded craftwork tool and notion storage pocket sleeves and/or a plurality of patterns for the plurality of sleeves disposed on a top side of one or more sleeve pattern sheets;

wherein each insert and/or each sleeve is sized to fit into one or more of a plurality of storage pockets of one or more transparent ring binder storage sheets, wherein each storage pocket is sized to hold one or more craftwork tools and/or notions and one of the inserts and/or the sleeves, each inserted into the storage pocket via an opening of the storage pocket, wherein each sleeve has one folded end forming a sleeve opening opposite to the folded end, wherein the sleeve is sized to hold an inserted end of one or more of the craftwork tools and/or the craftwork notions, each craftwork tool and/or notion inserted into the sleeve via the sleeve opening when the sleeve opening has the same orientation as the storage pocket opening;

wherein the plurality of stickers comprise blank stickers, stickers each printed with one of a plurality of sizes of the craftwork tools and/or the craftwork notions, and/or stickers each printed with a plurality of types of the craftwork tools and/or the craftwork notions, and wherein the plurality of stickers are sized to adhere to one or more of the following: the inserts and/or the sleeves, the transparent ring binder storage sheets, one or more transparent or translucent envelopes sized to fit into one or more of the storage pockets and to hold one or more of the craftwork tools and/or the craftwork notions, and/or a ring binder sized to hold the one or more transparent ring binder storage sheets.

2. The craftwork tool and notion storage kit of claim 1, further comprising one or more of the following:

the ring binder;

one or more of the transparent ring binder storage sheets;

one or more of the transparent or translucent envelopes;

one or more blank pattern sheets;

adhesive tape;

one or more pens and/or markers; and a ruler.

3. The craftwork tool and notion storage kit of claim 2, wherein:

one or more sleeve pattern sheets is present, and wherein:

each sleeve pattern comprises, disposed on a top side of the sleeve pattern sheet:

one or more predetermined cutting areas comprising one or more cutting lines, optionally one or more solid cutting lines, for cutting a sleeve pattern out of one of the sleeve pattern sheets; and one or more predetermined folding areas comprising one or more folding lines, optionally one or more dashed folding lines, for assembling a folded end of a cut sleeve pattern.

4. The craftwork tool and notion storage kit of claim 3, wherein each sleeve pattern has a rectangular shape comprising a length and a width, wherein the length has a first end, a center, and a second end, and wherein the predetermined folding areas comprise:

a first folding line adjacent to the first end and extending across the width;

a second folding line between the first folding line and the center and extending across the width; and a third folding line and a fourth folding line, wherein the third folding line is parallel to the fourth folding line, and wherein the third folding line is separated from the fourth folding line by the width, and wherein the third folding line and the fourth folding line are perpendicular to and extending from the first folding line to the second folding line, defining a flap formed by an adjacent area of the pattern extending beyond the width.

5. The craftwork tool and notion storage kit of claim 4, wherein the craftwork tool and notion storage kit further comprises instructions for preparing the craftwork tool and notion storage kit, wherein preparing the craftwork tool and notion storage kit comprises performing the following steps:

optionally, providing a digital file comprising a graphic image of the plurality of sleeve patterns, the digital file configured for printing the plurality of sleeve patterns onto one or more blank sleeve pattern sheets, and printing the graphic image of the plurality of sleeve patterns from the digital file thereof onto a top side of one or more blank sleeve pattern sheets;

cutting the predetermined cutting areas of each sleeve pattern to form a plurality of cut sleeve patterns;

folding the predetermined folding areas of each cut sleeve pattern to form the sleeve opening on the top side of each of the cut sleeve pattern; and adhering the sleeve opening of each cut sleeve pattern to a bottom side of the cut sleeve pattern, optionally, using tape, glue, or any combination thereof, to form the plurality of sleeves.

6. The craftwork tool and notion storage kit of claim 5, wherein folding the predetermined folding areas of each cut sleeve pattern comprises performing the following steps:

folding the first end of each cut sleeve pattern at the first folding line toward the second folding line, to form a once-folded first end on the top side of the cut sleeve pattern;

folding the once-folded first end of each cut sleeve pattern at the second folding line toward the center, to form a twice-folded first end on the top side of the cut sleeve pattern; and folding the flap adjacent to each of the third folding line and the fourth folding line of each cut sleeve pattern toward the bottom side, to form the sleeve opening on the top side of each cut sleeve pattern.

7. The craftwork tool and notion storage kit of claim 5, wherein the preparing the craftwork tool and notion storage kit further comprises performing one or more of the following steps:

adhering one or more of the stickers onto one or more of the following:

one or more of the plurality of inserts;

one or more of the plurality of sleeves;

one or more of the transparent ring binder storage sheets;

one or more of the transparent or translucent envelopes; and the ring binder;

inserting one or more of the inserts and/or the sleeves into one or more of the storage pockets, such that the sleeve openings of the sleeves have the same orientation as the storage pocket openings;

inserting one or more of the transparent or translucent envelopes into one or more of the storage pockets;

inserting into the ring binder one or more of the transparent ring binder storage sheets containing one or more of the following: one or more of the inserts and/or the sleeves, and one or more of the transparent or translucent envelopes; and inserting one or more of the craftwork tools and/or the craftwork notions into one or more of the storage pockets.

8. The craftwork tool and notion storage kit of claim 1, wherein:

the plurality of inserts and/or the plurality of sleeves are made from heavy cardstock, optionally recycled heavy card stock;

the one or more transparent ring binder storage sheets are made from heavy gauge vinyl;

the one or more transparent ring binder storage sheets each comprise one to five rectangular storage pockets;

the transparent or translucent envelopes are made from glassine paper;

the ring binder is made from Kraft paperboard; and/or the ring binder comprises at least two rings.

* * * * *